US007596344B2

(12) United States Patent
Kosuge

(10) Patent No.: US 7,596,344 B2
(45) Date of Patent: Sep. 29, 2009

(54) CHARGING UNIT AND IMAGE FORMING APPARATUS INCORPORATING THE UNIT

(75) Inventor: Akio Kosuge, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/969,638

(22) Filed: Jan. 4, 2008

(65) Prior Publication Data

US 2008/0107452 A1 May 8, 2008

Related U.S. Application Data

(62) Division of application No. 11/028,611, filed on Jan. 5, 2005, now Pat. No. 7,340,200.

(30) Foreign Application Priority Data

Jan. 9, 2004 (JP) ..... 2004-004318
Oct. 8, 2004 (JP) ..... 2004-296877

(51) Int. Cl.
*G03G 15/02* (2006.01)

(52) U.S. Cl. ..... 399/168; 399/176

(58) Field of Classification Search ..... 399/107, 399/110, 111, 115, 168, 176; 361/221
See application file for complete search history.

(56) References Cited

U.S. PATENT DOCUMENTS 5,250,990 A 10/1993 Fujimura et al.
6,240,268 B1 5/2001 Nishiuwatoko (Continued)

FOREIGN PATENT DOCUMENTS

EP 1 331 526 A1 7/2003

(Continued)

OTHER PUBLICATIONS

Patent Abstracts of Japan, JP 2002-139889, May 17, 2002.

*Primary Examiner*—Hoan H Tran
(74) *Attorney, Agent, or Firm*—Oblon, Spivak, McClelland, Maier & Neustadt, L.L.P.

(57) ABSTRACT

A charging unit is disclosed capable of reducing undue variation and fluctuation margin of a charging gap, and controlling accurately the proper gap durably over the change of environmental conditions, which is suitably incorporated into an image forming apparatus. The charging unit is configured to charge an image bearing member in a non-contact arrangement, including a charging roller provided with a core shaft, a charging member formed of electroconductive resin integrally disposed on the periphery of the core shaft, and gap holding members formed of insulating resin each disposed at respective ends of the charging member outside an image forming region. The control of the charging gap is feasible by either forming the gap with a charging member having such a materials condition as to satisfy the relation, $|G_{30}-G_{10}|\times 5<G_{20}$, where $G_{10}$, $G_{20}$ and $G_{30}$ are the gap averages at 10°, 20° and 30° C., respectively; or providing the charging roller with gears mounted on respective ends to be engaged with further gears mounted on flanges of the image bearing member to be driven along the rotation, and forming these gears such that the least common multiple of numbers, Nc and Np, is Nc×Np, where Nc and Np are the numbers of gear teeth for the charging roller and image bearing member, respectively.

7 Claims, 7 Drawing Sheets

U.S. PATENT DOCUMENTS

| | | | | |
|---|---|---|---|---|
| 6,899,983 | B2 | 5/2005 | Tamoto et al. | |
| 6,961,529 | B2 | 11/2005 | Kosuge | |
| 7,155,146 | B2 | 12/2006 | Kosuge et al. | |
| 7,251,437 | B2 * | 7/2007 | Tamoto et al. | 399/159 |
| 7,263,308 | B2 * | 8/2007 | Harada et al. | 399/100 |
| 7,295,802 | B2 * | 11/2007 | Kabata et al. | 399/351 |
| 2001/0012460 | A1 | 8/2001 | Sato et al. | |
| 2002/0051654 | A1 | 5/2002 | Niimi et al. | |
| 2003/0180071 | A1 | 9/2003 | Suda | |

FOREIGN PATENT DOCUMENTS

| | | |
|---|---|---|
| JP | 6-317973 | 11/1994 |
| JP | 7-301973 | 11/1995 |
| JP | 8-184980 | 7/1996 |
| JP | 8-202125 | 8/1996 |
| JP | 8-339092 | 12/1996 |
| JP | 11-218945 | 8/1999 |
| JP | 2000-206805 | 7/2000 |
| JP | 3126889 | 11/2000 |
| JP | 2001-194868 | 7/2001 |
| JP | 2001-249575 | 7/2001 |
| JP | 2001-312121 | 11/2001 |
| JP | 2001-337515 | 12/2001 |
| JP | 2002-55508 | 2/2002 |
| JP | 2002-108059 | 4/2002 |
| JP | 2002-139893 | 5/2002 |
| JP | 2002-229241 | 8/2002 |
| JP | 2002-229307 | 8/2002 |
| JP | 2002-251055 | 9/2002 |
| JP | 2003-66693 | 3/2003 |
| JP | 2003-76101 | 3/2003 |
| JP | 2003-295582 | * 10/2003 |
| JP | 2003-316130 | * 11/2003 |
| JP | 2003-330249 | 11/2003 |
| JP | 2006-154491 | * 6/2006 |

* cited by examiner

CHARGING UNIT AND IMAGE FORMING APPARATUS INCORPORATING THE UNIT

CROSS-REFERENCE TO RELATED APPLICATIONS

This application is a division of and claims the benefit of priority under 35 U.S.C. §120 from U.S. Ser. No. 11/028,611 filed Jan. 5, 2005, now U.S. Pat. No. 7,340,200 and claims the benefit of priority under 35 U.S.C. §119 from Japanese Patent Application Nos. 2004-004318 filed Jan. 9, 2004 and 2004-296877 filed Oct. 8, 2004, the entire contents of each of which are incorporated herein by reference.

BACKGROUND OF THE INVENTION

1. Field of the Invention

The invention relates generally to charging units and image forming apparatuses incorporating the units, and more specifically to a charging unit configured to reduce fluctuations of a charging gap, caused by the change in environmental conditions, a process cartridge, and an image forming apparatus incorporating the charging unit.

2. Discussion of the Background

The process of electrophotographic image formation is well known and is useful for both analog and digital copying and other reproduction techniques. Generally, the electrophotographic reproduction process is initiated by performing substantially uniform charging onto an image bearing member.

With respect to the charging, various devices and apparatuses have been proposed for creating a uniform electrostatic charge or charge potential on a photoconductive surface prior to the formation of latent images thereon.

Previously, corona generating devices such as scorotrons have been utilized to the charging, which is electrically biased to a high voltage potential.

Several problems have been associated with corona generating devices. For example, the use of very high voltages requires special insulation, inordinate maintenance of charging wires, and generates arcing caused by non-uniformities, and the contamination of corona wires. More importantly, it generates ozone and oxides of nitrogen, which eventually results in an adverse effect on the quality of the final output print produced by the reproduction apparatus.

As an alternative to corona generating devices, contact charging devices using roller or brush have recently been incorporated into various machines.

Since a charging roller operates to charge a photoreceptor while contacting thereto, the applied voltage is relatively low compared to non-contact chargers such as scorotrons, the amount of the above-mentioned generation of gaseous components such as ozone and NOx, can be reduced.

The contact charging devices, however, have several difficulties such as, for example, contamination by toner particles electrostatically adsorbed onto image bearing member (photoreceptor) and concomitant uneven charging, thereby resulting in an adverse effect on the life of charging unit.

In order to obviate the toner contamination, the method is previously known utilizing a film which is fixed to the ends of charging roller to form a minute gap between the roller and a photoreceptor. Alternatively, spacers are disposed to be fit into steps or grooves formed at the ends of charging roller to also form a minute gap. The range of gap width in these cases is disclosed ranging from 30 to 240 μm. (For example, Japanese Laid-Open Patent Applications No. 2001-194868, 2002-55508, 7-301973 and 8-202125.)

Although elastic members such as rubber or sponge are conventionally used for forming the charging roller, other materials also have been disclosed such as resinous materials (Japanese Laid-Open Patent Applications No. 2001-337515 and 2003-66693).

Also disclosed are several methods of forming the charging roller such as disposing rollers at the ends of charging roller to form a gap between a charging member and an image bearing member (Japanese Laid-Open Patent Applications No. 2001-312121 and 2000-206805); and forming an uppermost protective layer of a photoreceptor by dispersing inorganic particulates to improve abrasion resistance and mechanical strength of an organic photoconductor (Japanese Laid-Open Patent Application No. 8-339092), or particles of fluorocarbon resin to promote lubricating properties (Japanese Laid-Open Patent Application No. 11-218945).

As a further example, another charging roller as non-contact elastic member has been disclosed in Japanese Laid-Open Patent Application No. 2002-229307, in which the width of charging gap is found to fluctuate in the circumferential and axial directions ranging from 10 to 40 μm, and which the charging roller is operated under a DC bias potential superposed by AC bias which can be subjected to low voltage control.

Furthermore, a still another charging roller has been disclosed with the structure of spacers disposed at the ends of charging roller outside image forming region of an image bearing member, in which a charging member is formed of a resistive layer formed of fluorocarbon resin as the major component, an uppermost protective layer of a photoreceptor is dispersed with particulates of metal oxides or fluorocarbon resin, and the process of charging can be controlled for respective process units color by color (for example, Japanese Laid-Open Patent Applications No. 2002-251055, 2003-076101 and 8-184980).

With respect to the toner contamination described earlier, the degree of the contamination can be reduced by disposing the charging roller in non-contact arrangement compared with the contact manner.

However, there exists an upper limit for the width of the gap between charging roller and photoreceptor (which is hereinafter referred to as "charging gap") primarily due to the properties of materials for forming the charging roller. Then, if the charging gap is larger exceeding a certain tolerance, abnormal discharge takes place and uneven image density emerges in the images produced.

In addition, since the proper value of charging bias varies depending on the charging gap, undesirable situation arises even in the case where the charging gap is within the certain tolerance: if a large deviation exits in the charging gap, the charging bias cannot be large enough to retain a suitable charging voltage where the charging gap is large, while discharge energy may be too large at the location where the charging gap is small.

As a result, the charging potential decreases due to the deficient charging bias for the former case, while filming of toner and additives onto photoreceptor and/or the increase in photoreceptor abrasion take place for the latter case due to the excessive discharge energy.

It is therefore preferable for the charging gap to be adjusted properly not only in terms of its average but also in deviation and fluctuation margin.

For example, in the case when the charging member is formed of rubber, the member suffers from a relatively large change in hardness and this result in a large change in charging gap. In order to obviate this difficulty, the methods have been disclosed in Japanese Laid-Open Patent Applications No. 2002-108059 and 2002-139893, in which several means for measuring charging gaps and then adjusting ones according to the change in environmental conditions.

In spite of the abovementioned disclosures, various difficulties remain yet to be solved.

For example, with respect to the proper adjustment of average and deviation described above, several descriptions have previously been found on the charging gap concerning its average and tolerance (the range of the charging gap for which uniform charging can be made). However, almost none has been found on the margin of fluctuation during the rotation of charging roller and photoreceptor, and the charging gap deviation in the longitudinal direction of the photoreceptor.

In the case when the charging member is formed of rubber, the difficulty persists in accuracy of cutting work of the rubber material and in relatively large change in hardness with temperature.

With respect to charging member formed of resinous materials, on the other hand, the materials have advantages for the ease of cutting work from its appropriate hardness. It has drawbacks due to the hardness, however, such as abrasion over the period of time when the resinous material is used as a thin film to form the gap forming member, and/or filtering out of adhesive agent from the edge portions and concomitant toner adhesion thereto.

When the photoreceptor formed of organic photoconductors, some damages may take place at the locations to which the charging forming member is brought into contact.

Such damage may be obviated by providing step portions at the ends of the gap charger to be disposed with an elastic material having a relatively large thickness as disclosed in Japanese Laid-Open Patent Application No. 2002-55508. In addition, with a similar structure providing circular groove formed in the step portion to be fit with a gap forming member, the noted damage can be obviated and slipping out of the gap forming member from the step portion can be prevented without using any adhesive agent.

Although some improvement of durability is expected by the use of the thick gap forming member, there persists a difficulty of relatively large thickness and concomitant increase in deviation of the charging gap.

In the disclosures, Japanese Laid-Open Patent Applications No. 2001-312121 and 2000-206805, the gap forming members each formed to be in contact with the surface of the photosensitive layer outside of image forming region of the photoreceptor, and degradation of the photoreceptor can be alleviated. However, a further gap between the charging layer and the gap forming member has to be provided to prevent the leakage there between. This may result in an undue increase in the length of core shaft of the charging roller and the size of the image forming apparatus as a whole.

In addition, although some adjustments of the charging gap according to the change in environmental conditions may be feasible to a certain extent by the methods disclosed in Japanese Laid-Open Patent Applications No. 2002-108059 and 2002-139893, the precision of the measurements is in the range of several tens of microns, and the measurements have to be carried out preferably under actual operating conditions. This may necessitate complex and costly mechanisms for measurements and adjustments.

It is an object of the present invention, therefore, to provide a charging unit configured to reduce fluctuations of charging gap, caused by the change in environmental conditions without additional means for measurement and adjustment and to achieve dependable durability at low cost, a process cartridge with the charging unit, and the methods for measuring and setting the charging gap.

It is a further object to provide an image forming apparatus incorporating the charging unit of the invention, capable of performing image duplication with excellent image qualities.

SUMMARY OF THE INVENTION

Accordingly, an exemplary embodiment of the invention provides a charging unit and an image forming apparatus incorporating the charging unit, having most, if not all, of the advantages and features of similar employed units and materials, while reducing or eliminating many of the aforementioned disadvantages.

The following description is a synopsis of only selected features and attributes of the present disclosure. A more complete description thereof is found below in the section entitled "Description of the Preferred Embodiments."

The present invention overcomes the problem of insufficient accuracy of charging gap control to thereby achieve proper control not only in terms of its average but also in deviation and fluctuation margin, since it is essential to control the charging gap properly in order to output stable images by reproduction over a long period of time by image forming apparatus.

Being embodied as a full-color printer, the image forming apparatus according to the invention comprises an image bearing member, a charging unit configured to charge the image bearing member in a non-contact arrangement, and the charging unit comprises a charging roller.

The charging roller herein comprises a core shaft, a charging member formed of electroconductive resin integrally disposed on a periphery of the core shaft, and two gap holding members each disposed on respective ends of the charging member to form a spatial gap, or charging gap, between the image bearing member and the charging member.

One aspect of the present invention involves controlling a fluctuation margin of the charging gap caused by the change of environmental conditions, which is performed in terms of fluctuation characteristics of the charging member by setting a materials condition of the charging member beforehand within a predetermined range.

This is carried out in practice by the steps of:

(a) the environmental condition is taken as an ambient temperature;

(b) the midpoint is obtained as the standard for the change in the ambient temperature;

(c) higher side and lower side ambient temperatures are determined as the temperatures higher and lower by a predetermined temperature from the midpoint, respectively;

(d) an average of the charging gap at the higher side ambient temperature is obtained as the first average and a further average of the charging gap at the lower side ambient temperature is obtained as the second average; and (e) the materials condition of the charging member is set such that an absolute value of the difference between the first and second averages multiplied by an integer is equal to, or smaller than the average of the charging gap at the midpoint.

For example, the materials condition of the charging member may be set so as to satisfy a relation, $$|G_{30}-G_{10}|\times 5<G_{20},$$

where $G_{20}$ is the average of the charging gap at the midpoint 20° C., $G_{30}$ the average at the higher side temperature 30° C., and $G_{10}$ the average at the lower side temperature 10° C.

In another aspect of the invention, the control of the charging gap is achieved with respect to the structure of the charging unit as a combination of the charging roller and the image bearing member through the gear engagement.

That is, the charging roller is provided with gears to be engaged with further gears of the image bearing member to be driven along the rotation of the image bearing member with an approximately constant velocity, in which these gears are designed for the least common multiple of numbers Nc and Np to be Nc×Np, where Nc and Np are numbers of gear teeth for charging roller and image bearing member, respectively.

In still another aspect, the control of the charging gap is carried out by forming the charging roller and the image bearing member so as to satisfy the relations, $$20\ \mu m \leqq g \leqq 80\ \mu m, \text{ and}$$

$$Gmax - Gmin \leqq 40\ \mu m,$$

at an arbitrary location in either the axial or peripheral direction of the image bearing member, where g is a charging gap between image bearing member and charging member, and Gmax and Gmin are maximum and minimum values of the charging gap g, respectively, in a change with a rotation of the image forming member in either the axial or peripheral direction of an image forming region on the image bearing member.

In addition, the control of the charging gap is fortified by forming the charging roller and the image bearing member so as to satisfy the relations, $$20\ \mu m \leqq Gmin\ (C, E1, E2),$$

$$Gmax\ (C, E1, E2) \leqq 80\ \mu m, \text{ and}$$

$$Gmax - Gmin \leqq 40\ \mu m,$$

where (i) Gmax (C), Gmax (E1) and Gmax (E2) are maxima of the charging gap at the respective locations in a change with a rotation of the image forming member; (ii) Gmin (C), Gmin (E1) and Gmin (E2) are minima of the charging gap similarly at the respective locations; (iii) Gmax is a maximum among Gmax (C), Gmax (E1) and Gmax (E2); and (iv) Gmin is a minimum among Gmin (C), Gmin (E1) and Gmin (E2), representing by C, E1 and E2 the several locations on an image forming region of the image bearing member such as the middle and respective ends, respectively.

The charging gap is formed by providing two gap holding members of sheet-shaped insulating resin each disposed at respective ends of the charging member, or alternatively, by forming two step portions each having a predetermined depth in the radial direction and providing two gap holding members formed of heat-shrinking insulating resin to be fit respectively to the two step portions.

Each of the noted step portions may be of a shape of circular groove. For the charging gap formation, holding members are each disposed at respective ends of the charging member to form an integrated structure, and adjustment of the diameter of the integrated structure may be made through cutting and polishing the surface of the integrated structure.

The image bearing member suitable in use in the invention may comprise an organic photoconductor. A protective layer is disposed as an uppermost layer overlying the photosensitive layer, containing metal oxide particles for protecting the photoreceptor image bearing member by improving durability. In addition, lubricant particles of fluorocarbon resin, for example, can be dispersed in the protective layer to improve the lubricating properties of the surface of image bearing member.

The thus formed charging roller and image bearing member are suitably incorporated into the charging unit and the charging unit is, in turn, incorporated into the full-color printer.

Alternatively, the charging unit including the charging roller and image bearing member may form in advance an integral structure, a process cartridge, to subsequently be incorporated into the printer. This process cartridge can be handled conveniently as a single unit detachably with respect to the casing main body of the full-color printer.

In yet another aspect, in the case where the image forming apparatus is a full-color image forming apparatus of a tandem-type including a plurality of charging rollers, AC biases applied to respective charging rollers are set individually during image forming operation.

In addition, DC bias superposed by an AC bias is suitably adopted in the invention to control the effects of the charging gap because the charging gap always fluctuates slightly even after careful setting within a certain range with the rotation of the photoreceptor and charging roller.

In order for the photoreceptor to be charged in uniform, it is effective to have the charging bias applied to the charging roller with a properly determined DC bias superposed by an AC bias having a peak-to-peak voltage of at least twice the discharge starting voltage between photoreceptor 5 and charging roller 14.

In addition, since uneven charging has been found appreciable for low frequency of the applied AC bias, the frequency of the AC bias is preferably set equal to, or larger than the frequency f (Hz) corresponding to seven times linear velocity V (mm/s) of the image bearing member.

Since abnormal discharge takes place for too high frequencies of the applied AC bias, which tends to cause the increase in abrasion rate of the photoreceptor 5 and the generation of filming of toner and external additives, it is preferred for the frequency of the AC bias be adjusted to satisfy the relation, $$7 \times V \leqq f \leqq 12 \times V.$$

Furthermore, the constant voltage mode for the AC biasing operation is preferred to overcome several undue effects such as failure in voltage follow-up and concomitant emergence of abnormal images caused by the control in the constant current mode.

These and other features and advantages of the invention will be more clearly seen from the following detailed description of the invention which is provided in connection with the accompanying drawings.

BRIEF DESCRIPTION OF THE DRAWINGS

In the following drawings, like references numerals will be used to refer to like elements between the various figures, in which.

DETAILED DESCRIPTION OF PREFERRED EMBODIMENTS

In the detailed description which follows, specific embodiments of a charging unit and an image forming apparatus incorporating the charging unit are described, which are capable of obviating the aforementioned difficulties.

It is understood, however, that the present disclosure is not limited to these embodiments. For example, it is appreciated that the use of the units, apparatuses and materials properties included therein may also be adaptable to any form of imaging systems. Other embodiments will be apparent to those skilled in the art upon reading the following description.

Figure 1:
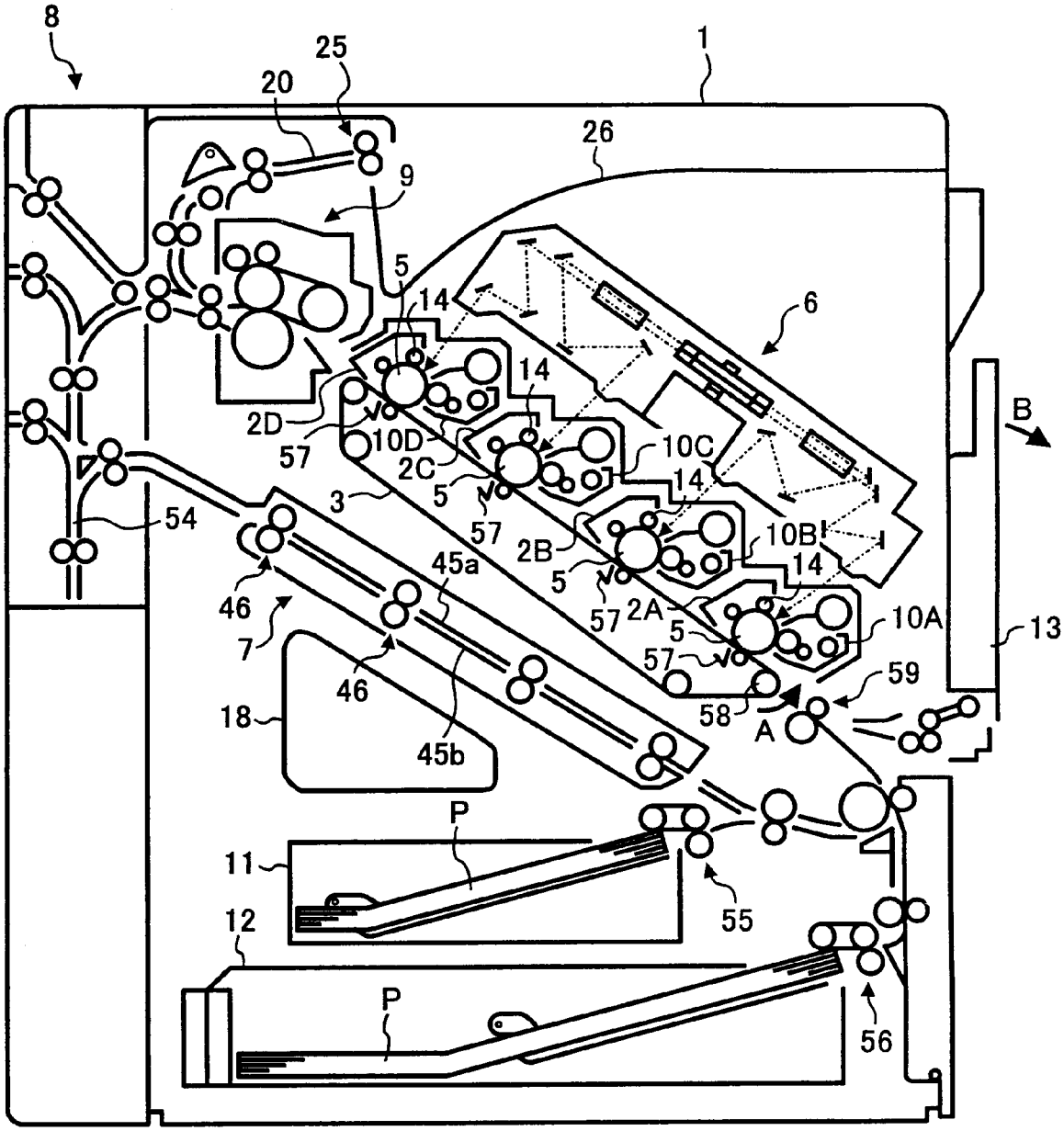
FIG. 1 illustrates the overall configuration of a tandem-type direct transfer full-color printer according to one embodiment disclosed herein.

Referring to FIG. 1, there is shown an image forming apparatus embodied as a tandem-type direct transfer full-color printer according to the present invention.

In the casing main body 1 of the full-color printer, four photoreceptor units are detachably provided each including photoreceptors 5 as image bearing members, each corresponding to magenta (M), cyan (C), yellow (Y) and black (Bk) colors.

Upon receiving a full-color image data, the photoreceptors 5 each rotate in clock wise, and the surfaces of the image bearing member 5 are uniformly charged by charging rollers 14 which each operates as charging member.

According to the present invention, the full-color printer as an image forming apparatus includes at least an image bearing member 5 and a charging unit configured to charge the image bearing member in a non-contact arrangement. The charging unit comprises a charging roller 14.

The charging roller herein includes a core shaft 104, a charging member 102 formed of electroconductive resin integrally disposed on a periphery of the core shaft, and two gap holding members 103 formed of insulating resin each disposed on respective ends of the charging member to form a spatial gap, or charging gap g, between the image bearing member 5 and charging member 102.

In order to output stable images by reproduction over a long period of time by means of the image forming apparatus, it is essential to form and to control the charging gap properly.

Figure 7:
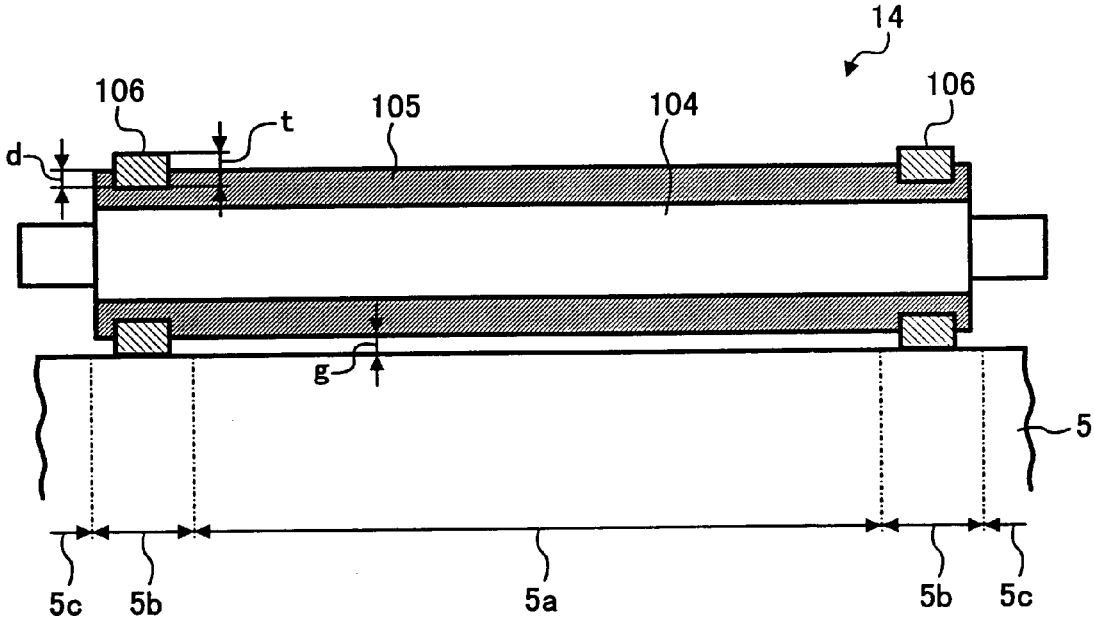
FIG. 7 is a cross sectional view illustrating another charging gap formed between a charging roller and an image forming member according to another embodiment disclosed herein.
Figure 9:
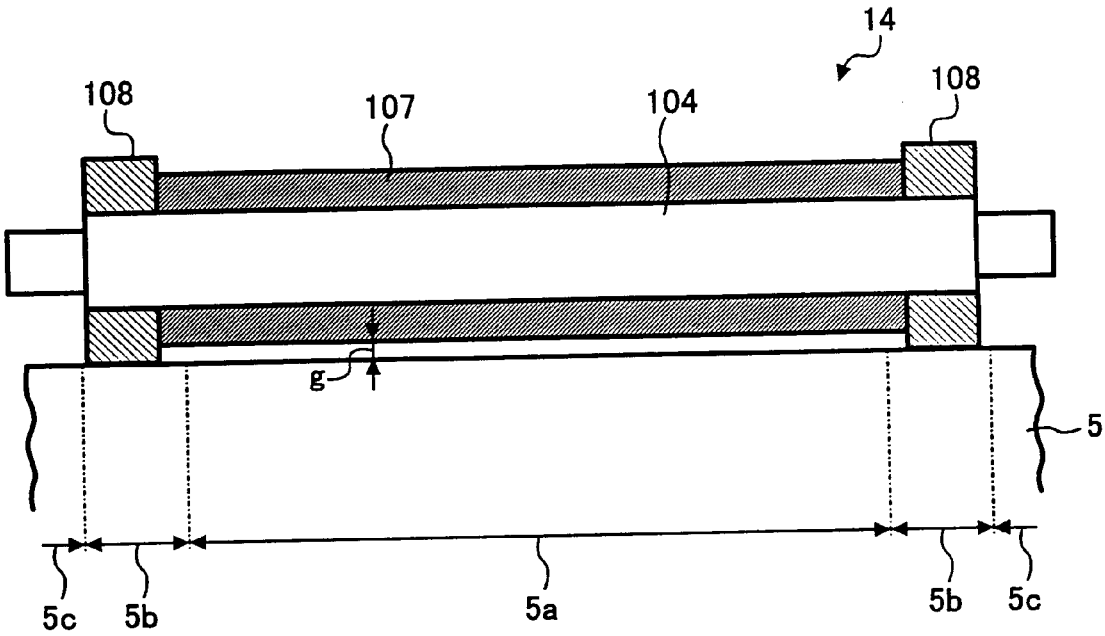
FIG. 9 is a cross sectional view illustrating a charging gap formed between a charging roller and an image forming member according to still another embodiment disclosed herein.

The charging gap g is formed by providing two gap holding members 103 of sheet-shaped each disposed at respective ends of the charging member, or alternatively, by forming two step portions each having a predetermined depth in the radial direction and providing two gap holding members 103 to be fit respectively to the two step portions (FIGS. 7 and 9).

Each of the noted step portions may be of a shape of circular groove. For the charging gap formation, gap holding members are each disposed at respective ends of the charging member to form an integrated structure, and adjustment of the diameter of the integrated structure is made through cutting and polishing the surface of the integrated structure.

As described earlier, it is preferable to control the charging gap properly against the change in the ambient conditions, for example, to output stable images by reproduction over a long period of time by means of the image forming apparatus. This is illustrated by the control of fluctuation margin of the charging gap performed in the present invention.

For example, a fluctuation margin of the charging gap as the distance between the image bearing member 102 and the charging member 103 caused by the change of environmental conditions may be controlled in terms of fluctuation characteristics of the charging member by setting a materials condition of the charging member beforehand within a predetermined range.

This is carried out in practice by the steps of:

(a) the environmental condition is taken as an ambient temperature;

(b) the midpoint is obtained as the standard for the change in the ambient temperature;

(c) higher side and lower side ambient temperatures are determined as the temperatures higher and lower by a predetermined temperature from the midpoint, respectively;

(d) an average of the charging gap at the higher side ambient temperature is obtained as the first average and a further average of the charging gap at the lower side ambient temperature is obtained as the second average; and (e) the materials condition of the charging member is set such that an absolute value of the difference between the first and second averages multiplied by an integer is equal to, or smaller than the average of the charging gap at the midpoint.

Alternatively, the control of the charging gap may also be achieved with respect to the structure of the charging unit as a combination of the charging roller 14 and the image bearing member 5 through the gear engagement.

That is, the charging roller 14 is provided with gears (not shown) each mounted on respective ends to be engaged with further gears (not shown) each mounted on flanges on respective ends of the image bearing member and to be driven along the rotation of the image bearing member with an approximately constant velocity, in which the gears of charging roller 14 and the image bearing member 5 are provided such that the least common multiple of numbers Nc and Np is Nc×Np, where Nc and Np are numbers of gear teeth for charging roller and image bearing member, respectively. A more detailed description on this setting will be made later on.

In addition, the control the charging gap may alternatively be carried out in practice with respect to specific parameters such as (1) the range of the variation of the charging gap g;

(2) the range of the difference, Gmax−Gmin, where Gmax and Gmin are maximum and minimum values of the charging gap g, respectively, in the change with the rotation of the image forming member in the either axial or peripheral direction of an image forming region on the image bearing member; and (3) the range of the variation of the values of charging gap minima Gmin (C, E1, E2), maxima Gmax (C, E1, E2), and the difference, Gmax−Gmin, at several locations C, E1 and E2 on the image forming region on the image bearing member such as the middle and respective ends, respectively.

The thus formed charging roller 14 is suitably incorporated into the charging unit and the charging unit is, in turn, incorporated into the full-color printer.

The charging unit including the charging roller 14 may alternatively form an integral structure as a process cartridge which can be handled as a single unit detachably with respect to the casing main body 1 of the full-color printer.

Still in addition, the charging bias has also been examined closely in the present invention, since the charging gap g always fluctuates slightly even after careful setting within a certain range during the rotation of the photoreceptor 5 and charging roller 14.

It has been found effective to apply a charging bias to the charging roller 14 in the form of properly determined DC bias superposed by an AC bias, giving a further consideration to its frequency in this case, which yields the uniform charging and concomitant effects such as reducing undue abrasion of photoreceptor 5 and suppressing the generation of filming of toner particles and external additives.

Having generally described this invention, further understanding can be obtained by reference to certain specific examples which are provided herein for the purpose of illustration only and are not intended to be limiting.

In the first place, a charging unit and an image forming apparatus incorporating the charging unit will be detailed herein below according to one embodiment of the invention in reference to FIGS. 1 through 6.

As a first exemplary embodiment, the overall configuration of a tandem-type direct transfer full-color printer will be described referring to FIG. 1.

In the casing main body 1 of the full-color printer, four photoreceptor units 2A, 2B, 2C and 2D are detachably provided each including photoreceptors 5 as image bearing members. The photoreceptor units 2A through 2D are identical in structure. In addition, the photoreceptor unit 2A is configured to form images corresponding to magenta (M) color, the unit 2B corresponding to cyan (C) color, the unit 2C to yellow (Y) color, and the unit 2D to black (Bk) color.

Being placed approximately at the middle of the casing body 1, a transfer unit is provided with a transfer belt 3, which is spanned around plural rollers to be rotatable in the direction designated by the arrow A in the drawing.

In addition, four transfer brushes 57 are provided each placed at the locations inside the transfer belt 3 corresponding to respective photoreceptors 5. The outward face of the transfer belt 3 is disposed to be in contact to the respective photoreceptors 5 in the photoreceptor units 2A through 2D.

A plurality of developing units 10A through 10D are provided each containing the toners of different colors corresponding to respective photoreceptor units 2A through 2D.

The developing units 10A through 10D are identical in structure with the exception of the difference only in the color of toner included therein, that is, two-component type developing units. The developing units 10A, 10B, 10C and 10D are configured to handle the toners of colors M, C, Y and Bk, respectively. In each of the developing units 10A through 10D, a developing agent is contained, which consists of developer and carrier granules.

Each of the developing units 10A through 10D includes a developing roller disposed opposing to photoreceptor 5 a screw for displacing the developing agent while stirring, and a sensor for detecting toner concentration.

The developing roller consists of a sleeve ratatably disposed outside, and a magnet affixed inside the roller. During developing process steps, a necessary amount of toner is supplied from a toner container (not shown) corresponding the signal output from the toner concentration sensor.

The toner is made of a binder resin, coloring agent, and a charge control agent, as major ingredient, further including other additives, where relevant.

Examples of the binder resin include polystyrene, styrene-acrylate copolymers, and polyester resin.

As the coloring agent for use in the toner (of yellow, magenta, cyan and black, for example), any of pigments and dyes conventionally known can be employed. The content of the colorant agent in the toner is preferably from about 0.1 to 15 parts by weight based on 100 parts by weight of the toner.

Specific examples of the charge control agent include a nigrosine dye, a chromium-containing metal complex dye, and a quaternary ammonium salt, which may be used selectively depending on the polarity of electric charging for toner particles. The content of the charge control agent in the toner is preferably from about 0.1 to 10 parts by weight based on 100 parts by weight of the toner.

The toner may further include a fluidity promoting agent, as one of further additives, such as fine particles of metal oxide like silica, titanium oxide and aluminum oxide, and these particles surface-treated by silane coupling agents, titanate coupling agents, and combinations thereof; and fine particles of polymer such as polystyrene, polymethyl methacrylate, and polyvinylidene fluoride. The average particle diameter of the fluidity promoting agent is preferably from 0.01 to 3 μm, and the content thereof in the toner is preferably from about 0.1 to 7 parts by weight based on 100 parts by weight of the toner particles.

The toner for use in two-component developing in the present invention is produced by several conventional methods used individually or in combination.

In the kneading-pulverizing method by way of example, the toner is formed by dry mixing the ingredients such as binder resin, coloring agent like carbon black and other necessary additives; heat melting and kneading by an extruder, or a biaxial or triaxial mixer; pulverized by a crusher such as a jet mill after solidified by cooling; and fractionating by a air-classifier.

The toner may also be manufactured directly from a monomer, coloring agent, and additives by suspension polymerization or nonaqueous dispersion polymerization.

The carrier is formed either by a core member (or core) itself or a core provided thereon with a coated layer. As the core with the coated layer for use in the present invention, ferrite or magnetite is generally used. The diameter of the particle core is suitably from 20 to 60 μm.

Examples of the material for forming the coated layer include tetrafluoroethylene, vinylidene fluoride, hexafluoropropylene, perfluoroalkyl vinylether, hydrogen substituted vinylethers, and fluorine substituted vinylketones.

The method of coating the layer includes conventional methods such as spray or dip coating onto the surface of the particle core.

Referring again to FIG. 1, the optical writing unit 6 is provided over the photoreceptor units 2A through 2D, and a duplex unit 7 is provided under the transfer belt 3. As a full-color printer, a sheet inverting unit 8 is further provided on the left side (on the drawing) of the casing main 1 for either inverting, then discharging a transfer sheet P (recording medium), or forwarding the sheet to the duplex unit 7.

The optical writing unit 6 includes four laser diodes (LDs) as light sources each for use in respective colors, a polygon scanner consisting of a six-face polygonal (or polygon) mirror and a polygon motor, f-θ lenses each disposed in the paths of light beams emanated from the LD sources, other lenses, and mirrors. Thus, the light beams are deflected while scanned by the polygon scanner to be irradiated onto the surface of respective photoreceptors 5.

The duplex unit 7 includes plural (e.g., four in this embodiment) conveyance roller pairs 46 with corresponding pairs of conveyance guide plates 45*a* and 45*b*. In duplex printing mode in which a previously simplexed sheet P is subjected to printing an image on the opposite side of the page, the simplexed sheet P is forwarded to an inverting conveyance path 54 in a sheet inverting unit 8 to be switched back, receiving the sheet P after switched back, and forwarding again to a sheet feeding unit.

The sheet inverting unit 8 includes a further plurality of conveyance roller pairs with corresponding pairs of conveyance guide plates (FIG. 1) for receiving the simplexed sheet P, and subsequently either inverting the side of the sheet P in case of duplex mode printing, and forwarding back to the duplex unit 7; or leading the simplexed sheet P to the disposal to the exterior either as it is or as its side inverted.

The sheet feeding unit is provided with sheet feeding cassettes 11 and 12 for separating sheet by sheet from a stack of transfer sheets by way of respective separation-feed units 55 and 56.

A fixing system 9 is provided between the transfer belt 3 and sheet inverting unit 8 for fixing images onto the sheet P through heating and pressurization. Disposed downstream of sheet conveyance direction from fixing system 9, an sheet inverting-disposal path 20 is provided as a branch path for disposing a received sheet P to a disposal tray 25 by way of a disposal roller pair 25.

The sheet feeding cassettes 11 and 12 are placed one above the other in a lower portion of the casing main 1, which are each capable of storing transfer sheets P different in size suitably selected for feeding.

A manual paper feeding tray 13 is further provided openably in the direction designated by the arrow B (FIG. 1) on the right-hand side of the casing main 1, for enabling the sheet feeding manually from the exterior after releasing open the feeding tray 13.

In the next place, process steps performed in the full color printer will be detailed for forming full-color images according to the exemplary embodiment disclosed herein.

Upon receiving a full-color image data, the photoreceptors 5 each rotate in clock wise (in FIG. 1), and the surfaces of the photoreceptors 5 are uniformly charged by charging rollers 14 as charging members, which will be described later on.

Subsequently, onto thus charged surface of the photoreceptors 5, laser light beams are irradiated while scanned by the optical writing unit 6 such that a first laser beam corresponding to M color image is incident onto the photoreceptor 5 in the photoreceptor unit 2A, a second laser beam corresponding to C color image onto the photoreceptor unit 2B, a third laser beam corresponding to Y color image onto the photoreceptor unit 2C, and a fourth laser beam corresponding to Bk color image onto the photoreceptor unit 2D. Thus, latent images are formed corresponding to respective color images.

These latent images are then developed using toners of respective colors M, C, Y and Bk on arriving at the locations of developing units 10A, 10B, 10C and 10D along the rotation of the photoreceptors 5, whereby toner images are created in four colors.

On the other hand, a transfer sheet P is fed from a selected one of the sheet feeding cassettes 11 or 12 by separation-feed unit 55 (or 56) to be nipped by the registration roller pair 59 disposed immediately in front of the transfer belt 3. The transfer sheet P is then fed forward by the registration roller pair 59 in the proper timing to be brought into contact to the respective toner images of four colors.

The transfer sheet P is positively charged by an adsorbing roller 58 which is disposed in the vicinity of the entrance to the transfer belt 3, whereby the transfer sheet P can be attached electrostatically to the face of the transfer belt 3. As a result, the transfer sheet P can be forwarded along the rotation of the belt transfer 3 while adsorbed thereon, and toner images of respective colors are successively transferred onto the transfer sheet P, whereby a full-color toner image is formed finally as a superposition of toner images of four colors.

The fixing unit 9 includes a fixing roller having an internal heat source and a pressing roller pressed against the fixing roller. The transfer sheet P carrying the unfixed full-color toner image is conveyed through a fixing nip between the fixing roller and the pressing roller, whereby the toner image is melt-fixed onto the transfer sheet by heat and pressure by the fixing unit 9.

Thereafter, the thus image fixed transfer sheet P is lead through the sheet feeding unit to a selected one of the sheet conveyance paths depending on the operation mode such as inverted to be forwarded to a disposal tray 26 at the top of the casing main 1; lead to the disposal to the exterior after the fixing unit 9 without inversion; and in the case of the duplex mode printing, forwarded to an inverting conveyance path 54 in a sheet inverting unit 8 to be switched back, received after switched back, forwarded to the duplex unit 7, forwarded again to the imaging unit provided with the photoreceptor units 2A through 2D to be image formed on the rear side of the sheet P, and subsequently disposed.

In the case when the image formation is set to the mode of two or more pages of printing, the abovementioned image forming steps are repeated.

Next, process steps will be described herein below for forming black-and-white (or monochrome) images using the full color printer according to the exemplary embodiment disclosed herein.

Upon receiving black-and-white image data, subordinate (or slave) rollers, which are disposed opposing to the adsorbing roller 58 and serve to support the transfer belt 3, are displaced downward so as the transfer belt 3 be removed from three photoreceptors 5 for forming M, C and Y toner images.

The photoreceptor 5 for Bk color rotates in clock wise and the surface of the photoreceptor 5 is charged uniformly by charging rollers 14.

Subsequently, a laser light beam is irradiated while scanned onto thus charged surface of the photoreceptors 5 by the optical writing unit 6 such that the laser beam corresponding to Bk color image is incident onto the photoreceptor 5 in the photoreceptor unit 2D. Thus, a latent image is formed corresponding to Bk color image.

The latent image is subsequently developed using Bk color toner on arriving at the location of the developing unit 10D, whereby Bk toner image is created.

In the meantime, several units other than those corresponding to the Bk color come to halt such as three photoreceptor units 2A, 2B and 2C and developing units 10A, 10B and 10C, whereby undue wear of the photoreceptors 5 and developing agent can be obviated.

On the other hand, a transfer sheet P is fed from a selected one of the sheet feeding cassettes 11 or 12 by separation-feed unit 55 or 56 to be nipped by the registration roller pair 59 disposed immediately in front of the transfer belt 3. The transfer sheet P is then fed forward by the registration roller pair 59 in the proper timing to be brought into contact to the Bk toner image.

The transfer sheet P is positively charged by the adsorbing roller 58 which is disposed in the vicinity of the entrance to the transfer belt 3, whereby the transfer sheet P can be attached electrostatically to the face of the transfer belt 3. The transfer sheet P can therefore be forwarded along the rotation of the belt transfer 3 while adsorbed thereon even though the transfer belt 3 is removed from three photoreceptors 5 for forming M, C and Y toner images. The toner image of Bk color is then transferred onto the transfer sheet P, whereby a black-and-white toner image is formed.

In order to feed forward the transfer sheet P stably by means of electrostatic adsorption, it is necessary that at least the outermost layer of the transfer belt 3 has a high resistance.

In a manner similar to the abovementioned steps of full-color images, the transfer sheet P carrying the unfixed full-color toner image is conveyed through a fixing nip between the fixing roller and the pressing roller, whereby the toner image is melted and fixed onto the transfer sheet by heat and pressure by the fixing unit 9.

The image fixed transfer sheet P is then processed properly through the sheet feeding unit depending on the operation mode.

In the case when the image formation is set to the mode of two or more pages of printing, the abovementioned image forming steps are repeated.

Suitable examples for forming the transfer belt 3 include a seamless belt consisting of resins such as polyvinylidene fluoride, polyimide, polycarbonate, and polyethylene terephthalate. These materials may be used either as is or adjusting resistance properties by adding suitable additives such as carbon black, for example.

On top of the base material formed of the above noted resins, the transfer belt 3 may further be provided with a surface layer by dip coating or spray coating to form a layered structure.

Figure 2:
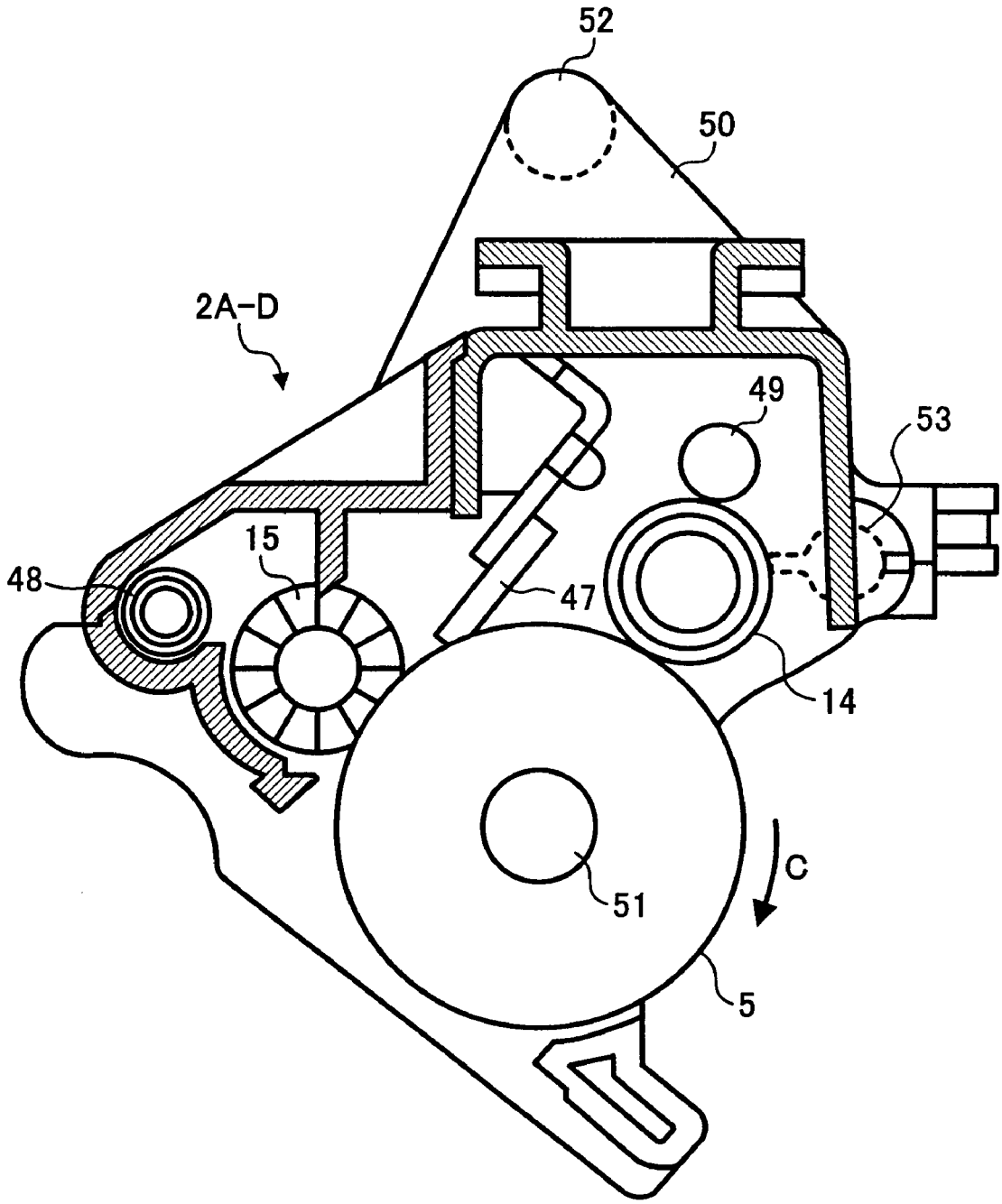
FIG. 2 is a diagrammatic side view illustrating the construction of a photoreceptor unit according to one embodiment disclosed herein.

FIG. 2 is a diagrammatic side view illustrating the construction of the photoreceptor units.

Referring to FIG. 2, each of the photoreceptor units 2A through 2D includes a photoreceptor 5 for forming thereon an electrostatic latent image, a charging roller 14 for uniformly charging the photoreceptor 5, and a roller brush 15 and a cleaning blade 47 for cleaning the surface of the photoreceptor 5.

The charging roller 14 is disposed including at least gap holding members each formed to be in contact to the surface of photosensitive layer outside of image forming region of the photoreceptor 5 such that a minute charging gap is formed between the photoreceptor in the image forming region.

The charging roller 14 is disposed also to be in contact to a cleaning roller 49 in use for cleaning the surface of the charging roller 14.

The cleaning roller 49 is a roller brush, which is made of a metal shaft core provide thereon with electrostatically implanted conductive fibers and brought into contact to the charging roller 14 under own weight. The cleaning roller 49 rotates along the charging roller 14 so as to remove toner and other particles from the surface of the roller 14 during the rotation.

The charging unit according to one embodiment disclosed herein is thus formed consisting of the charging roller 14, a bias application unit (not shown) for applying a charging bias voltage, and the cleaning roller 49.

The toner, which is scraped off from the photoreceptor 5 by cleaning blade 47 made of at least polyurethane rubber, is displaced toward a toner conveying auger 48 by the roller brush 15. The charging unit is therefore designed such that thus recovered toner waste is conveyed by the rotating toner conveying auger 48 to the toner waste storage 18 of FIG. 1.

In the present embodiment the photoreceptor 5 is formed having an outer diameter of 30 mm. The photoreceptors 5 included in each of the photoreceptor units rotate at a linear velocity of 125 mm/s in the direction designated by the arrow C in FIG. 2. The roller brush 15 then rotates counterclockwise in synchronous with the rotation of the photoreceptor 5.

Each of the photoreceptor units 2A through 2D is provided with reference units integrally combined with a bracket, in which the reference units includes a primary reference unit 51 as the reference for properly loading the charging unit with respect to the casing main 1, a secondary reference unit 52 as the reference to frontal side positioning, and another secondary reference unit 53 as the reference to rear side positioning. By means of the integral structure of the reference units with the bracket, proper loading and positioning of the photoreceptor units 2A through 2D is assured in the present image forming apparatus.

It should be noted in this context that the photoreceptor units 2A through 2D each can be formed of process cartridge type to be exchangeable with relative ease and the photoreceptor 5 and charging roller 14 are alternatively included in one process cartridge.

By arranging the photoreceptor 5 and charging roller 14 in such a structure as the position thereof can be definitely fixed, the exchange of parts or units in the apparatus can be performed even by a user with relative ease with precision.

As will be detailed later on, this is illustrated by the process of charging gap adjustment in the present invention; even when a minute adjustment is required such as the charging gap adjustment between the photoreceptor 5 and charging roller 14 as a process cartridge, no gap adjustment is required by replacing the charging roller 14 simultaneously with the photoreceptor 5.

Although the above illustration has been made on the integration of the photoreceptor 5, charging roller 14 and cleaning means, this is by no means limiting. Namely, the developing unit may further be included in the process cartridge and the cleaning means may be formed as a further process cartridge.

Figure 3:
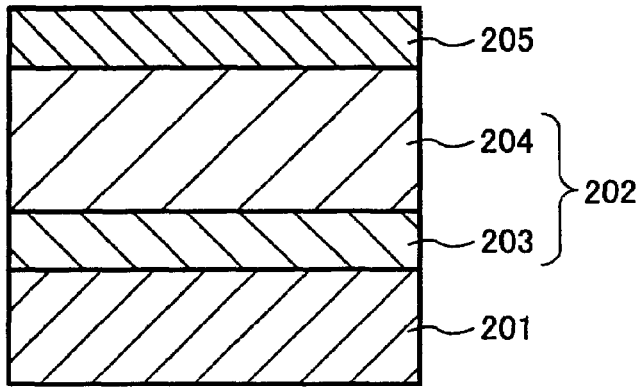
FIG. 3 is a section view illustrating a layered structure of the image forming member viewed in the direction represented by the arrow L according to one embodiment disclosed herein.
Figure 4:
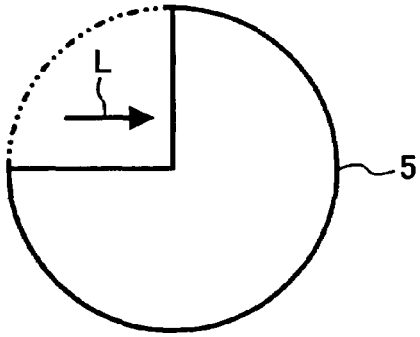
FIG. 4 is a cross section of the image forming member with the arrow L representing a viewing direction.

Referring to FIG. 3, a photoreceptor suitably used in the present invention will be explained herein below, in which the structure of the photoreceptor 5 is illustrated as a section viewed from the direction of the arrow L in FIG. 4.

The photoreceptor 5 is a layered structure formed on an electroconductive substrate 201, including several layers formed successively thereon such as a charge generation layer 203 as a photosensitive layer 202, a charge transport layer 204 and a protective layer 205 as an uppermost layer.

Figure 5:
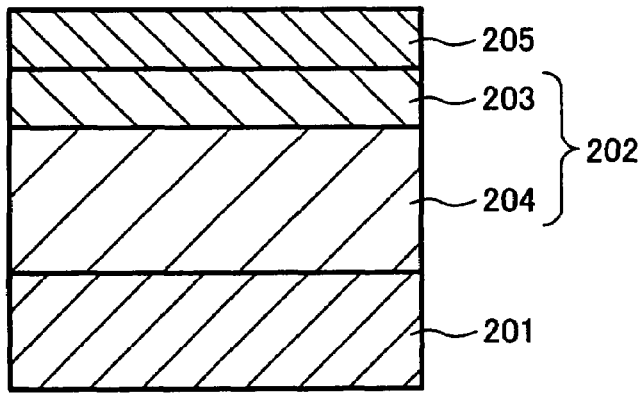
FIG. 5 is a further section view illustrating another layered structure of the image forming member.

Alternatively, as shown in FIG. 5, the photoreceptor 5 may be formed on an electroconductive substrate 201, including a charge transport layer 204 and a charge generation layer 203 thereon in that order, and a protective layer 205.

In addition, an undercoat layer may be formed between the electroconductive substrate 201 and photosensitive layer 202.

Suitable materials for use as the electroconductive substrate 201 include the materials having a volume resistance of $10^4$ Ωcm or less such as, for example, metals like aluminum and stainless steel, and an endless belt of a metal such as nickel.

The undercoat layer includes a resin as a main component. Since the photosensitive layer is formed typically by coating a liquid including an organic solvent on the undercoat layer, the resin used in the undercoat layer preferably has satisfactory resistance to conventional organic solvents.

Specific examples of the resin include water-soluble resins such as polyvinyl alcohol resins, casein and polyacrylic acid sodium salts; alcohol soluble resins such as nylon copolymers; and thermosetting resins capable of forming a three-dimensional network, such as polyurethane resins, melamine resins, alkyd-melamine resins and epoxy resins.

The undercoat layer may include fine powders of metal oxides such as titanium oxide, silica, alumina and zirconium oxide, to obviate the occurrence of Moire fringes in the images and to decrease residual potential of the photoreceptor.

The undercoat layer is typically formed by liquid coating with a suitable solvent. The thickness of the undercoat layer typically ranges from 0 to 5 μm.

The charge generation layer 203 includes a charge generation material as the main component, exemplified by azo pigments such as mono-azo, dis-azo and triazo, and phthalocyanine pigments such as metal phthalocyanine and metal-free phthalocyanine. The charge generation layer 203 is formed by dispersing the pigments together with a binder resin such as polycarbonate in suitable solvent such as tetrahydrofuran and cyclohexane, and subsequently coating the thus prepared dispersion liquid by dipping of spraying coating. The thickness of the charge generation layer 203 is typically in the range from 0.01 to 5 μm.

The charge transfer layer 204 is formed, for example, by the following method; a charge transfer material and a binder resin are dispersed or dissolved in a solvent such as tetrahydrofuran, toluene and dichloroethane to prepare a charge transfer layer coating liquid, and the coating liquid is coated on the charge generation layer 203 and dried to form a charge transfer layer 204.

The low molecular weight charge transfer materials are divided into electron transport material and positive-hole transport material.

Examples of the electron transport material include electron accepting type compounds such as chloranil, bromanil, tetracyanoethylene, tetracyanoquinodimethane, 2,4,7-trinitro-9-fluorenon, 2,4,5,7-tetranitro-9-fluorenon, 2,4,8-trinitrothioxanthone, and 1,3,7-trinitrodibenzothiphene-5,5-dioxide.

Examples of the hole transport material include electron donating type compounds such as oxazole derivatives, oxadiazole derivatives, imidazole derivatives, triphenylamine derivatives, phenyl hydrazine derivatives, monoarylamines derivatives, diarylamines derivatives, triarylamines derivatives, stilbene derivatives, diarylmethane derivatives and triarylmethane derivatives.

Specific examples of the binder resin suitably used in combination with the charge transfer material include polystyrene, styrene-acrylonitrile copolymers, styrene-butadiene copolymers, polyesters, polyvinyl acetate, polyarylates, phenoxy resins, polycarbonates, polyvinyl butyral resins, polyvinyl toluene, acrylic resins, silicone resins, epoxy resins, melamine resins, urethane resins, phenolic resins, and alkyd resins.

The thickness of the charge transfer layer 204 typically ranges from 15 to 30 μm.

The protective layer 205 is disposed as an uppermost layer overlying the photosensitive layer 202, and containing metal oxide particles for protecting the photoreceptor 5 by improving durability.

Examples of suitable materials for use in the protective layer 205 include binder resins such as styrene-acrylonitrile copolymers, styrene-butadiene copolymers, acrylonitrile-styrene-butadiene copolymers, olefin-vinyl monomer copolymers, chlorinated polyethers, aryl resins, phenolic resins, polyacetal resins, polyamide resins, polyamideimide resins, polyacrylate resins, polyarylsulfone resins, polybutylene resins, polybutylene terephthalate resins, polycarbonate resins, polyethersulfone resins, polyethylene resins, polyethylene terephthalate resins, polyimide resins, acrylic resins, polymethylpentene resins, polypropylene resins, polyphenyleneoxide resins, polysulfone resins, polyurethane resins, polyvinyl chloride resins, polyvinylidene chloride resins, epoxy resins and other similar resins.

Examples of the suitable solvent include tetrahydrofuran, toluene and dichloroethane.

In addition, metal oxide particles can be included in the resin of protective layer 205 to improve the abrasion resistance such as alumina, silica, titanium oxide, tin oxide, zirconium oxide and indium oxide.

The amount of the metal oxide particles included in the resin is generally in the range from 5 to 40% by weight and preferably from 10 to 30%.

The amount of the metal oxide particles of 5% or less results a relatively large abrasion with inferior resistance, while the amount of the metal oxide particles exceeding 40% causes another adverse effect of a considerable increase in the potential in bright portions during exposure to such an extent that the decrease in sensitivity cannot be neglected.

As the method for forming the protective layer 205, a coating method such as spray coating can be utilized.

The thickness of protective layer 205 is generally in the range from 1 to 10 μm and preferably from 3 to 8 μm. Too small a thickness of the protective layer 205 results inferior resistance, while too large a thickness causes not only a decrease in productivity of the photoreceptor during manufacturing but also an increase in residual potential after prolonged usage.

The diameter of the metal oxide particles added to the protective layer 205 is preferably in the range from 0.1 to 0.8 μm. If the diameter is too large, the surface ruggedness of protective layer 205 increases and cleaning properties decreases. As a result, light for the image exposure is scattered with more ease and image resolution decreases. In case of too small the diameter, by contrast, anti-abrasion capability of the photoreceptor decreases.

In addition, lubricant particles of fluorocarbon resin, for example, can be dispersed in the protective layer 205 to improve the lubricating properties of the surface of photoreceptor 5.

The amount of the lubricant particles included in the surface layer is preferably in the range from 40 to 75% by weight of the solid additives in the layer. The amount of less than 40% by weight is unsatisfactory for slight effects of lubrication improvement, while the amount of larger than 75% by weight is also unsatisfactory because of the decrease in the mechanical strength of the layer.

Examples of the fluorocarbon resin include polytetrafluoroethylene, polyhexafluoroethylene, polytrifluoroethylene, polyvinylidene fluoride and polyvinyl fluoride.

The diameter of the fluorocarbon lubricant particles dispersed in the protective layer 205 is preferably in the range from 0.1 to 5 μm.

The lubricant particles can be dispersed in a manner similar to the metal oxide particles using similar binders and resins utilizing the spray coating method, for example. The thickness of the surface layer 205 is preferably in the range from 3 to 8 μm.

In addition, the metal oxide and lubricant particles may be dispersed into protective layer 205 either individually or in combination. Further, a dispersing agent may additionally be included in the protective layer 205 to improve dispersibility of the particles of metal oxide and fluorocarbon resins. Examples of the dispersing agent suitably include those used with conventional coating compositions such as paint.

Still further, some of the aforementioned charge transport materials may effectively included and antioxidants may also be included in the protective layer 205, where relevant.

Figure 6:
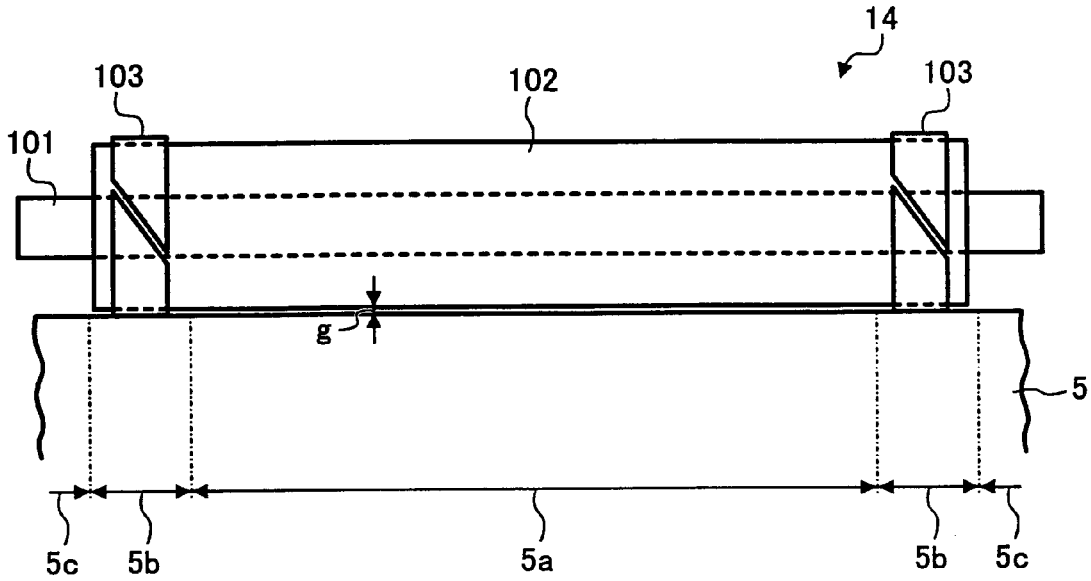
FIG. 6 is a side view illustrating a charging gap formed between a charging roller and an image forming member according to one embodiment disclosed herein.

FIG. 6 is a section view of the charging roller as the first embodiment the charging roller for use in the image forming apparatus.

Referring to FIG. 6, the charging roller 14 includes a rotating core shaft 101 of a metal bar as an electroconductive supporting member, a charging layer 102 consisting of electroconductive resin, and gap holding members 103, 103 each formed of sheets on both ends of the charging roller 14 (more specifically, of the charging layer 102).

The gap holding members 103, 103 each formed to be in contact with the surface of the photosensitive layer 5*b* outside of image forming region 5*a* of the photoreceptor 5 such that a minute charging gap g is formed between the photoreceptor 5 in the image forming region 5*a*. The numeral 5*c* denotes the portion of non-coated (or non-photosensitive) on the photoreceptor 5.

By forming the gap holding members 103, 103 in contact with the surface of the photosensitive layer 5*b*, it becomes unnecessary to provide a further gap between the charging layer 102 and the gap holding member 103 to prevent the leakage. As a result, an undue increase in size can be avoided for the image forming apparatus.

Suitably used in forming the core shaft 101 are metals such as stainless steel and iron.

Too small a diameter of the core shaft 101 may suffer from non-negligible bending during cutting works for forming the charging layer 102 or being pressed against the photoreceptor 5, whereby difficulty may result in attaining necessary gap accuracy. If the diameter is too large, in contrast, the size and weight of the charging roller 14 tend to be large. The diameter is therefore preferably in the range from 6 to 10 mm.

Suitable materials for use in the charging layer 102 include the materials preferably having a volume resistance ranging from $10^4$ to $10^9$ Ωcm.

If the volume resistance is too small, uneven charging may result being caused by minute irregularity of resistance and concomitant uneven discharge over the area of the charging layer 102. In case of too large volume resistance, by contrast, necessary discharge does not generate, whereby even charged potentials cannot be obtained. The volume resistance suitable for use in the charging layer 102 is provided by adding suitable electroconductive materials into the base resin.

The materials suitably used as the base resin include polyethylene, polypropylene, polymethyl methacrylate, polystyrene, and acrylonitrile-butadiene-styrene copolymer (ABS). These base resins can be fabricated with relative ease because of excellent moldability.

Examples of the electroconductive materials for use in the charging layer 102 include ion-conductive materials such as a quaternary ammonium salt containing polymer, such as polyethylene or polyolefin which contain the quaternary ammonium salt. Some of the polymers are well known and commercially available. Although the polyolefin is cited herein including the quaternary ammonium salt in the present embodiment, the polymers other than polyolefin may also be used including the quaternary ammonium salt.

The ion-conductive materials are compounded uniformly into the base resin by conventional methods using a kneader or biaxial mixer. The compounded material is subsequently injection or extrusion molded onto the core shaft 101 to thereby be shaped into a roller.

The amount of ion-conductive materials for the mixing is preferably in the range of 30 to 80 by weight per 100 by weight of base resin.

The thickness of the charging layer 102 preferably ranges from 0.5 to 3 mm. Too small the thickness of the charging layer 102 may cause difficulties in fabrication and inferior strength of the layer, while too large the thickness results in the decrease in charging efficiency caused by the resistance increase in addition to an undue increase in size of the charging roller 14.

In addition, a surface layer may additionally be disposed having a several-tens-micrometer thickness by conventional coating method with a composition to prevent undue toner adherence.

The gap holding member 103 is formed of a sheet of resin such as polyester, polyethylene terepthalate and polyimide, with one side of the sheet coated by adhesive agent to be attached onto the both ends of the charging layer 102. Therefore, the charging gap g is determined substantially by the thickness of the sheet.

It is noted in this context, the sheet as the gap holding member 103 is slantingly cut, as shown in FIG. 6, such that the seam is also slantingly formed relative to the axis of rotation of the core shaft 101 such that neither the portion of the sheet overlap nor the portion of lacking the sheet be resulted.

The charging roller 14 is provided with a gear (not shown) mounted on the end portion of the core shaft 101, which is engaged with a further gear (not shown) mounted on a flange of the photoreceptor 5. The charging roller 14, therefore, rotates along the rotation of the photoreceptor 5 driven by a driving motor therefor with a linear velocity approximately equal to each other in an engaging direction.

Since the charging layer 102 of charging roller 14 is structured not in direct contact with the photoreceptor 5, the imaging portion of the photoreceptor 5 will not suffer from any damage such as surface scratch, for example, even when a hard resin material is used for forming the charging layer 102 and an organic photoreceptor is used in the photoreceptor 5.

If the gap g becomes too large in width, an abnormal discharge may take place and uniform charging becomes difficult over the surface area of the photoreceptor 5. According to the results obtained from experiments by the inventor it is found that the gap width is preferably 100 μm or smaller, and more preferably 90 μm or smaller.

The fabrication with high accuracy is therefore requisite for both photoreceptor 5 and charging roller 14, and the rectilinearity of 20 μm or smaller is preferable for the structure. Among the factors affecting the charging gap g due to environmental conditions, the change in hardness of the charging layer 102 is predominant in the present structure.

Since the thickness of gap holding member 103 is several tens of microns at most, almost none of effects are appreciable from the change in thickness and hardness of gap holding member 103 even after the change in environmental conditions.

In order to reduce the effects on the charging gap g from environmental conditions, therefore, it is effective to form the charging layer 102 having a high hardness. The results obtained from experiments by the inventor have confirmed that the change of charging gap g resulted from environmental conditions can be reduced considerably by bringing the hardness of the charging layer 102 to the degree 50 or higher (JIS D).

It should be noted in this context as follows: although the hardness of the materials themselves included therein is an important factor for materializing the high hardness of the charging layer 102, the effects from the thickness of the charging layer 102 are also appreciable. As a result, the hardness is not of the materials included in the charging layer 102 alone, but of the charging roller 14 as a whole after its fabrication, which should be determined by the measurements using a hardness tester conforming to JIS K 7215.

Figure 8:
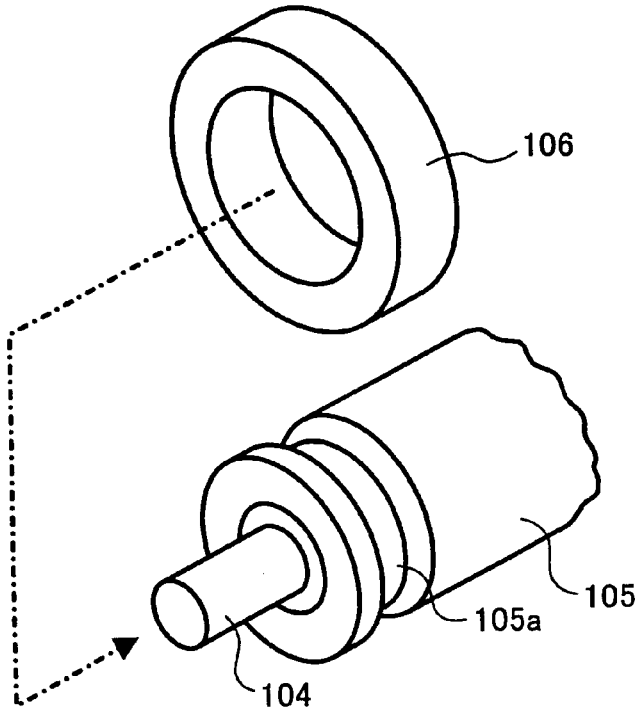
FIG. 8 is a perspective view of one of the end portions of the charging roller of FIG. 7.

As a second embodiment, another charging roller will be described herein below in reference to FIGS. 7 and 8.

In the description which follows, like references numerals will be used to refer to like elements included in the first embodiment, and the features similar to those in the first embodiment are herein abbreviated unless particularly necessary for clarifying characteristic features of the present embodiment.

Referring now to FIG. 7, the charging roller as the second embodiment thereof is characterized by providing step portions each having a certain depth in the radial direction of the charging roller 14 at both ends thereof, and by providing gap holding members onto the step portions, whereby a charging gap is formed.

The charging roller 14 includes a core shaft 104 of bar shaped metal provided with axial portions at both ends thereof each having a smaller diameter, a charging layer 105, and gap holding members 106, 106 each disposed at both ends of the charging roller 14 (more specifically, of the charging layer 105).

The gap member 106 is formed in the course of shaping the outer face of the charging layer 105, which is carried out by shaving steps (including cutting and grinding), as follows.]

Namely, referring to FIGS. 7 and 8, first forming step portions 105*a* each provided with circular grooves at the both ends of the charging roller 14 to be fitted later with gap holding members 106, forming the gap holding members 106 by disposing tubes formed of heat shrinking resin consisting fluorocarbon resins such as PFA (tetrafluoroethylene-perfluoroalkyl vinylether copolymers) and FEP (tetrafluoroethylene-hexafluoropropylene copolymers), fitting the thus formed gap holding member 106 into the step portions 105*a*, and applying heat so as the gap holding member 106 to be brought to tight fit to the step portions 105*a*.

These materials are known to have excellent releasing properties and effective for preventing the adherence of the toner. By using further fluorine resins for the materials, the appearance of discharge at the gap holding members 106 is prevented as well as the adherence of the toner.

Since the gap holding members 106 are formed by fitting into the circular groove formed in the step portion 105*a*, as mentioned above, both edges of the groove operate as a latch for the gap holding members 106. As a result, slipping out of the step portion can be prevented for the gap holding members 106 without using any adhesive agent.

The depth d of the step portion 105*a* can properly be determined after considering the thickness t of the heat contracting tube 106 as the gap holding member and the charging gap g as the present target.

Since the thickness in the radial direction of the gap holding member 106 can be increased by providing the step portion 105*a* as mentioned above, endurance of the gap holding member 106 is improved comparing with the case of attaching a sheet material as the gap holding member 103.

It should be noted, however, that too large a thickness of the heat contracting tube 106 may cause an unignorable variation of charging gap g due to deviation of the film thickens of the tube 106. According to the results obtained from the experiments by the inventor, it has been confirmed the thickness t of the heat contracting tube 106 is preferably in the range from 100 to 300 μm. By deposing the heat contracting tube 106 having such thickness, excellent endurance and sufficient gap accuracy both can be satisfied.

In a manner similar to the previous embodiment, among the factors affecting the charging gap g due to environmental conditions, the change in hardness of the charging layer 105 is predominant in the present structure as well. Although the thickness of gap holding member 106 is presently formed larger than that of the sheet for gap holding member 103 shown in FIG. 6, the thickness of gap holding member 106 is smaller than that of charging layer 105. As a result, the effects from the change in thickness and hardness of gap holding member 106 after the change in environmental conditions are not appreciable in the present case as well.

Accordingly, in order to reduce the effects on the charging gap g from environmental conditions, it is effective to form the charging layer 102 having a large hardness. The results obtained from experiments have confirmed that the change of charging gap g resulted from environmental conditions can be reduced considerably by bringing the hardness of the charging layer 102 to the degree 50 or higher (JIS D).

Figure 10:
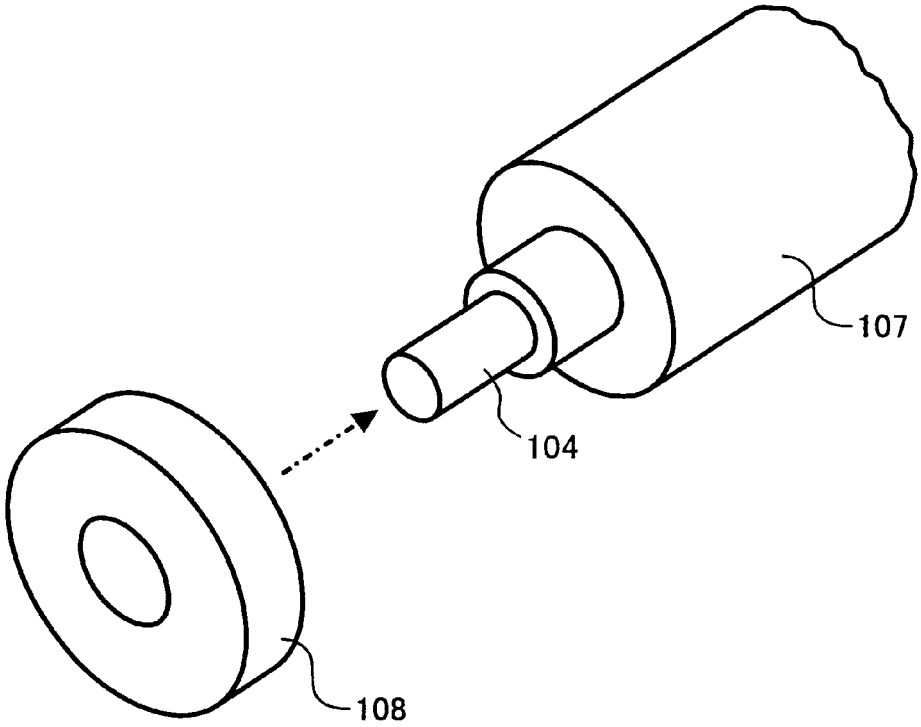
FIG. 10 is a perspective view of one of the end portions of the charging roller of FIG. 9.

As a third embodiment, still another charging roller will be described herein below in reference to FIGS. 9 and 10.

In the description which follows again, like references numerals will be used to refer to like elements included in the first embodiment, and the points similar to those in the first embodiment are abbreviated herein unless necessary to clarify characteristic features of the present embodiment.

The charging roller 14 includes a core shaft 104 of bar shaped metal, a charging layer 107, and gap holding members 108, 108 of ring-shape each disposed at both ends of the charging roller 14 (more specifically, of the charging layer 105).

The charging roller 14 is formed according to the following steps. Namely, referring to FIGS. 9 and 10, after forming a charging layer 107, gap holding members 108, which have been previously prepared, are affixed onto the respective ends of the core shaft 104 through at least one of processing methods such as press fitting and adhesive joining. The thus unified (or integrated) charging roller 14 (more specifically, core shaft 104) and gap holding member 108 are subjected simultaneously to the steps of adjusting the diameter of charging roller 14 through cutting and polishing.

With the present construction of the charging roller 14, the core shaft 104 and gap holding members 108 can be brought to be in-phase in fluctuation during rotation and the variation in the charging gap g can be reduced.

It is noted herein about the material for forming the gap holding member 108. Although electroconductive resin similar to those used for charging layer 107 may also be used in the gap holding member 108, insulating materials are preferred for the following reasons.

Namely, in the present construction, since the gap holding member 108 is brought into contact to the outside area of the image forming region of the charging layer 107 and accordingly no discharge takes place over this area. Therefore, by forming the gap holding member 108 with insulating materials without application of electric potential, deterioration of photosensitive layer by discharge and undue adhesion of toners can be avoided.

The method adaptable to unifying the core shaft 104 with gap holding member 108 is not limited to the press fitting and adhesive joining mentioned earlier. Other methods may also be applied such as two-toned molding which can mold two kinds of resins to thereby form both charging layer 107 and gap holding member 108 on the core shaft 104.

Suitable materials for forming the gap holding member 108 include resins such as polypropylene, polybutane, polyisoprene or ethylene-ethylacrylate copolymers, ethylene-methylacrylate copolymers, ethylene-vinyl acetate copolymers, ethylene-propylene copolymers, and ethylene-hexane propylene copolymers; and the aforementioned materials for forming the base of electro-conductive substrate such as polyethylene, polypropylene, polymethyl methacrylates, polystyrene, acrylonitrile-butadiene-styrene copolymers, and polycarbonate.

In this case, however, since the gap holding member 108 is brought into contact with the photosensitive layer 202, the material for forming the gap holding member 108 preferably has hardness smaller than charging layer 107. In addition, several materials may also be selected, for their excellent lubricating and less damaging properties, such resins as polyvinylidene fluoride, tetrafluoroethylene-perfluoroalkyl vinylether copolymers, and tetrafluoroethylene-hexafluoropropylene copolymers.

Since the gap holding member 108 is formed on the core shaft 104 in the present embodiment, the change in hardness of the charging layer 108 is predominant among the factors affecting the charging gap g due to the temperature variation, as long as the charging layer 107 consists of a material of high hardness.

In order to reduce the effects on the charging gap g from environmental conditions, therefore, it is effective to form the gap holding member 108 having a high hardness. The results obtained from experiments by the inventor have confirmed that the change of charging gap g resulted from environmental conditions can be reduced by bringing the hardness of the gap holding member 108 to the degree 45 or higher (JIS D).

It should be noted in this context as follows: too high a hardness of the gap holding member 108 may cause deteriorating effects on the photosensitive layer 202 with relative ease when the gap holding member 108 is made contact to photosensitive layer 202, and the durability of photoreceptor 5 may be adversely affected.

The results from experiments also have confirmed that the deteriorating effects on the photosensitive layer 202 can be suppressed by making the hardness of the gap holding member 108 to the degree 70 or higher (JIS D).

It is known that the charging gap g always fluctuates within a certain range with the rotation of the photoreceptor 5 and charging roller 14.

In order for the photoreceptor 5 to be charged in uniform under the circumstance as described above, it is effective to have a charging bias applied to the charging roller 14 to be an properly determined DC bias superposed by an AC bias having a peak-to-peak voltage of at least twice the discharge starting voltage between photoreceptor 5 and charging roller 14.

From experimental results it has been confirmed that uneven charging is found appreciable in strips for low frequency of the applied AC bias and that the frequency of the AC bias is preferably set equal to, or larger than the frequency f (Hz) corresponding to seven times linear velocity V (mm/s) of the photoreceptor.

In addition, since abnormal discharge takes place for too high frequencies of the applied AC bias, which causes with more ease the increase in abrasion rate of the photoreceptor 5 and the generation of filming of toner and its external additives, it has also been confirmed that the frequency of the AC bias is preferably set to be equal to, or smaller than the frequency f (Hz) corresponding to twelve times linear velocity V (mm/s) of the photoreceptor.

When the DC bias is superposed by the AC bias, the influence on the roller resistance from environment can be reduced by adopting the constant current control.

It should be noted that, when the photoreceptor 5 and charging roller 14 are placed in a non-contact arrangement, the charging gap g fluctuates with the rotation of the photoreceptor 5 and charging roller 14, as mentioned earlier. This may result several undue effects such as the failure in voltage follow-up by high voltage source in the constant current control mode and concomitant emergence of abnormal images. This difficulty can be obviated by adopting the constant voltage mode for the AC bias.

In such a case, it is also noted that the necessary AC bias voltage is different depending on the change in roller resistance due to environmental conditions and the magnitude of the charging gap. Since the necessary AC bias voltage is higher with increasing charging gap, it is feasible to set to properly AC voltages by providing suitable means capable of detecting AC current, monitoring and then readjusting the AC current in the off-period during image forming cycles.

In the next place, the methods of measuring a charging gap g will be described herein below.

Figure 11:
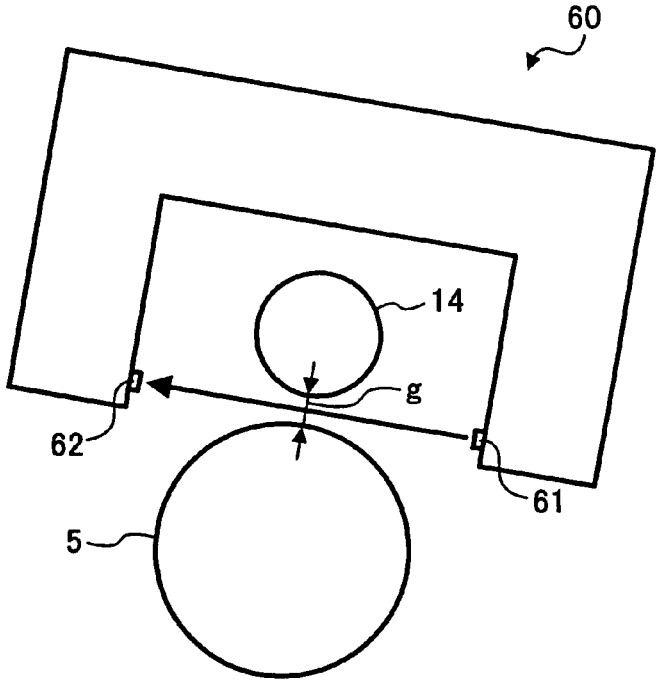
FIG. 11 is a diagrammatic side view illustrating the construction of a charging gap measuring unit.

FIG. 11 diagrammatically illustrates a measuring unit of the charging gap in the charging device according to one embodiment disclosed herein.

Referring to FIG. 11, first a photoreceptor unit including the photoreceptor 5 and charging roller 14 is properly set in the charging gap measuring unit 60. Laser light emanated from a light emitting device 61 comes to incident into a light receptor 62 after going through the charging gap, whereby the width of the charging gap can be obtained.

As the charging gap measuring unit 60, Laser Scan Micrometer LSM-600 (manufactured by Mitsuya Co. Ltd.) was used in present measurements. During the measurements using this unit, the photoreceptor 5 was able to be operated, whereby the charging gap was measured while rotating.

The light emitting device 61 and light receptor 62 are constructed integrally in the measuring unit such that the unit as a whole can travel in the longitudinal direction of the photoreceptor 5. As a result, the measurement of the charging gap can be performed at an arbitrary position along the longitudinal (axial) direction of the photoreceptor. With such an arrangement, it is feasible to measure the charging gap under actual operating conditions with high degree of accuracy.

According to the present embodiment in the invention fortified by the measurements described above, it has been found the change of the charging gap with temperature variation can considerably be reduced even without any gap adjusting means.

From the results obtained from the experiments, it has been confirmed the contamination from toner adhesion on the surface of charging roller 14 can be reduced by bringing the minimum value of the charging gap to be 15 μm or larger. Also confirmed is that uneven image density caused by abnormal discharge can be obviated by setting the maximum value to be 90 μm or smaller.

In addition, it has been found that a charging gap, which is stable independently of working environmental conditions, can be maintained by setting the margin of fluctuation in the average charging gap g between the average charging gap g at 10° C. and the further average charging gap g at 30° C. to be one fifth or smaller of the average charging gap g at 20° C.

The following examples are provided further to illustrate preferred embodiments of the invention, which are provided herein for the purpose of illustration only and are not intended to be limiting.

EXAMPLE 1

A plurality of charging rollers, A through F, were formed according to the there embodiments described above, and subsequently subjected to several measurements and observations such as charging gaps, the hardness of the charging roller, contamination on the roller, and defects on the photoreceptor, after the running test.

(Charging Roller A)

A charging layer was formed over the surface area of a stainless steel core shaft having an 8-mm-diameter, by injection molding a resin composition, which contains 60 parts by weight of ion-conductive agent consisting of polyolefin polymer with quaternary ammonium salt in 100 parts by weight of ABS resin, to find a volume resistance of $10^6$ Ωcm for the resultant charging layer.

Gap holding members, which were formed of 45-μm-thick polyethylene terephthalate sheets with 8-mm-width each provided with 15-μm-thick adhesive layer adhered thereto, were then affixed onto both ends of the charging layer, whereby a charging roller A was formed having an 11-mm-outer-diameter of the charging layer (with a structure of FIG. 6).

Thereafter, the hardness measurement was carried out on the charging roller A, and its hardness was found as the degree 63 (JIS D).

(Charging Roller B)

Utilizing core shaft and conductive resin composition similar to those for forming the charging roller A, another charging layer was formed over the surface area of the core shaft by injection molding, whereby a roller structure was formed.

In the course of shaping the outer face of the roller structure by cutting and grinding, step portions were formed at the both ends of the structure each having a width of 8 mm and a depth of 100 μm. And, a heat shrinking PFA tube was affixed to each end by heating at 120° C. for 20 minutes so as to result in a 150-μm-thick tube after shrinking. As a result, a second charging roller B was formed having an 11-mm-outer-diameter of the charging layer (having the structure of FIG. 7).

Thereafter, the hardness measurement was carried out on the charging roller B, and its hardness was found as the degree 63 (JIS D).

(Charging Roller C)

Utilizing core shaft and conductive resin composition similar to those for forming the charging roller A, another charging layer was formed over the surface area of the core shaft by injection molding, whereby a roller structure was formed.

Thereafter, a gap holding member of high density polyethylene having a width of 8 mm was affixed onto each end of the core shaft, and subjected simultaneously to the steps of adjusting the diameter through the steps of cutting and polishing, whereby still another charging roller C was formed having a 11-mm-outer-diameter of the charging layer (with a structure of FIG. 9).

Subsequently, the hardness measurements were carried out on the charging roller C, and the hardness values were found as the degree 63 and 58 (JIS D) for the charging layer and gap holding member, respectively.

(Charging Roller D)

The steps for forming another charging roller were repeated in a manner similar to the charging roller C with the exception that polyacetal resin was used for forming the gap holding member in place of the polyolefin polymer.

Thereafter, the hardness measurements were carried out on the charging roller D, and the hardness values were found as the degree 63 and 75 (JIS D) for the charging layer and gap holding member, respectively.

(Charging Roller E)

A charging layer consisting of epichlorohydrin rubber was formed over the surface area of a stainless steel core shaft having an 8-mm-diameter.

In a manner similar to that for forming the charging roller A, gap holding members, which were formed of 45-μm-thick polyethylene terephthalate sheets with 8-mm-width each provided with 15-μm-thick adhesive layer adhered thereto, were then affixed onto both ends of the charging layer, whereby a charging roller E was formed having an 11-mm-outer-diameter of the charging layer.

Thereafter, the hardness measurement was carried out on the charging roller A, and its hardness was found as the degree 29 (JIS D).

(Charging Roller F)

A charging layer consisting of epichlorohydrin rubber was formed over the surface area of a stainless steel core shaft having a 9-mm-diameter.

In a manner similar to that for forming the charging roller A, gap holding members, which were formed of 45-μm-thick polyethylene terephthalate sheets with 8-mm-width each provided with 15-μm-thick adhesive layer adhered thereto, were then affixed onto both ends of the charging layer, whereby a charging roller E was formed having an 11-mm-outer-diameter of the charging layer.

Thereafter, the hardness measurement was carried out on the charging roller F, and its hardness was found as the degree 33 (JIS D).

Evaluation process steps were then carried out on the thus formed charging rollers using an image forming system as a modification of IPSiO Color 8110 (by Ricoh Co., Ltd.).

The photoreceptor for use in the evaluation was prepared as a multilayered structure formed on an aluminum base member (or substrate) having a 30-mm-diameter, with several layers formed successively on the substrate such as an undercoat layer having a 3.5-μm-thickness, a charge generation layer having a 0.15-μm-thickness, a charge transport layer having a 22-μm-thickness, and a surface layer as a protective layer having a 5-μm-thickness, in that order.

The protective layer was formed by spray coating. The layers other than the protective layer were formed by dip coating. As the binder resin for use in both the charge transport and surface layers, polycarbonate was used, and alumina particles having a 0.3 μm average diameter were included in the surface layer in an amount of 25% by weight per all solid contents in the layer.

The photoreceptor and charging roller were properly set in a photoreceptor unit. The photoreceptor unit was, in turn, placed in the aforementioned charging gap measuring unit. With such an arrangement, the charging gap was measured under actual working conditions with high accuracy.

Charging gap measurements were carried out under various environmental conditions on the charging rollers formed earlier and the results from the measurements are shown in Table 1.

In order to reduce as much as possible the affects of the outer shape of photoreceptor to the measured magnitude of charging gap, one single photoreceptor was used through the measurements on the charging rollers.

TABLE 1

Results of charge gap measurements

| Charging roller | Charging gap (μm) 10° C. 15% | 20° C. 60% | 30° C. 54% |
|---|---|---|---|
| A | 53 | 52 | 51 |
| B | 52 | 49 | 44 |
| C | 48 | 47 | 45 |
| D | 55 | 54 | 54 |
| E | 35 | 25 | 6 |
| F | 51 | 43 | 29 |

It is clearly indicated in Table 1 that the charging roller F with the rubber roller has suffered from a large fluctuation of the charging gap by working conditions. In addition, also for the charging roller F the value of the gap itself was found smaller than the charging roller A in spite of the use of the same gap holding member for the measurements.

Also from the results, it is shown that, by setting the margin of fluctuation in the average charging gap g between the average charging gap g at 10° C. ambient temperature and the further average charging gap g at 30° C. to be one fifth or smaller of the average charging gap g at 20° C., the charging gap can be maintained to be stable independently of working environmental conditions.

The ambient temperatures were selected during the measurements such as 20° C. as the median with 30° C. at the higher side and 10° C. at the lower side. The temperature setting, however, is not limited to the present stepwise fashion.

Subsequently, several running tests were carried out under the abovementioned conditions, in which 20,000 copies were produced during each test. Additional experimental conditions were a processing speed of 125 mm/s, and an applied charging voltage, AC (f=900 Hz)+DC (−700 V). In addition, the ambient conditions were switched successively starting from 20° C. temperature and 60% humidity, 30° C. 54%, and 10° C. 15%, in that order.

(Results of Running Test)

For the charging roller A, although a small number of defects were generated in the portion of photosensitive layer in contact to the gap holding member 108, no abnormality was observed in copied images.

For the charging roller B, although the contamination on the charging roller was worsened slightly by the 30° C. 54% test, no abnormality in images was observed after 10° C. 15%.

For the charging roller C, although a small number of defects were generated in the portion of photosensitive layer in contact to the gap holding member 108, no abnormality was observed in the images.

For the charging roller D, the photosensitive layer was damaged in its portion in contact to the gap holding member at the point of about 35,000 copies during the test, and further steps for the test could not proceed due to the occurrence of charging bias leaks. Almost no contamination occurred on the charging roller in this case.

For the charging roller E, a serious contamination by toner on the charging roller was caused by the 30° C. 54% test, and image density irregularity, which was caused by inferior charging due to the contamination on the charging roller, was generated after the 10° C. 15% test.

For the charging roller F, a contamination by toner on the charging roller was caused to a certain extent but not so serious as the case of the charging roller E by the 30° C. 54% test, and image density irregularity, which was caused by inferior charging due to the contamination on the charging roller, was generated after the 10° C. 15% test.

The results obtained for the charging rollers are summarized in Table 2.

TABLE 2

Summary of measurement results

| Charging roller | $G_{20}/(G_{30}-G_{10})$ | Roller contamination | Defects on photoreceptor |
|---|---|---|---|
| A | 26 | ○ | ○ |
| B | 6.1 | ○ | ○ |
| C | 15.7 | ○ | ○ |
| D | 54 | ○ | X |
| E | 0.86 | X | ○ |
| F | 1.95 | X | ○ |

It is indicated in Table 2 that the contamination on the charging roller is suppressed more with the decrease in charging gap due to temperature fluctuation and with the increase in the value of the term $G_{20}/(G_{30}-G_{10})$. Therefore, it is shown that, by attaining a configuration such that the value of the term $G_{20}/(G_{30}-G_{10})$ is brought to be 5 or larger, the occurrence of contamination on the charging roller can be made minimal.

That is, by configuring the charging roller so as to satisfy the relation $|G_{30}-G_{10}|\times 5<G_{20}$, the occurrence of contamination on the charging roller can suitably be suppressed, where $G_{10}$, $G_{20}$ and $G_{30}$ are the averages of the charging gap at ambient temperatures 10°, 20° and 30° C., respectively.

Since it has been clarified that too high hardness of the gap holding member tends to cause deteriorating effects on the photoreceptor, another set of experiments were subsequently carried out such that the kind, and the grade of the materials for forming the gap holding member were altered to change the hardness.

Subsequently, charging rollers were formed using several different materials with the structure similar to the charging rollers C and D, and subjected to the tests for evaluating the hardness of gap holding member and deteriorating effects on the photoreceptor.

As the methods for the evaluation test of the thus formed charging rollers, running tests to produce 10,000 copies were adopted using the image forming system as a modification of IPSiO Color 8110. In order to obtain test results on the charging rollers, the outer appearance of the photoreceptor was observed, after the test, on its portion which was in contact to the gap holding member. The results obtained from the running test are shown in Table 3.

Several notations used in the table are © for indicating an outer appearance equivalent to the beginning, ○ a few defects on the surface, and X a rugged or tarnished surface.

Other notations related to materials are HDPE for representing high density polyethylene, LDPE low density polyethylene, PP polypropylene, EEA ethylene-ethyl acrylate copolymer, POM polyacetal, and ABS acrylonitrile-butadiene-styrene copolymer.

TABLE 3

| Hardness of gap holding member vs. deterioration of photoreceptor | | |
|---|---|---|
| Gap holding member | Hardness of the member | Appearance of photoreceptor |
| EEP | 44 | ◎ |
| LDPE | 46 | ◎ |
| HDPE | 58 | ○ |
| POM(1) | 65 | ○ |
| PP | 69 | ○ |
| POM(2) | 75 | X |
| ABS | 82 | X |

The results in Table 3 clearly indicates that deteriorating effects on the surface of photoreceptor are found more often with increasing hardness of the gap holding member and that, by utilizing the material having the hardness of the degree 70 (JIS D) or smaller, the damage on the photoreceptor surface can be suppressed to the level insignificant from the durability point of view.

As a further exemplary embodiment of image forming apparatus according to the present invention, the overall configuration of a tandem-type direct transfer full-color printer is similar to the first exemplary embodiment of image forming apparatus. In addition, toners and carriers similar to those used in the first exemplary embodiment are also utilized in the present embodiment, as well.

Therefore, the features similar to those in the first embodiment are herein abbreviated unless particularly necessary for clarifying characteristic features of the present embodiment.

Referring again to FIG. 1, the image forming apparatus according to the present embodiment is also a tandem-type direct transfer full-color printer.

The full-color printer includes at least photoreceptor units 2A through 2D including photoreceptors 5 as image bearing members, a transfer belt 3, an optical writing unit 6, developing units 10A through 10D, a fixing unit 9 and a sheet feeding unit.

These units and materials are similar in construction and in function to those for used for the printer in the first exemplary embodiment except the portions related to the charging unit including charging roller and gap holding member.

The charging unit in the present embodiment will be detailed herein below. This charging roller 14 is provided with two gears (not shown) each formed integrally at the ends of the roller 14, which are engaged with further two gears disposed at the ends of the photoreceptor 5. The charging roller 14 then rotates in synchronous with the rotation of the photoreceptor 5 with an approximately constant velocity.

When the numbers of gear tooth are assumed to be Nc and Np for the charging roller 14 and the photoreceptor 5, respectively, the gears are preferably formed in the present invention such that the least common multiple of the numbers Nc and Np is Nc×Np.

By setting the least common multiple of the numbers Nc and Np to be Nc×Np, the period of time can be prolonged as much as possible since the portions of charging roller 14 and photoreceptor 5 specifically congenial with each other can be brought into contact (or engaged) for that prolonged period of time along the rotation, whereby the local generation of filming and/or wear on the photoreceptor can be alleviated.

In a similar manner to the printer in the first exemplary embodiment, the charging roller in the present embodiment is also formed such that the gap holding member is brought into contact with the surface of the photosensitive layer outside of image forming region of the photoreceptor 5, and that a minute charging gap g is formed between the photoreceptor 5 in the image forming region 5*a*.

The charging gap g always fluctuates within a certain range with the rotation of the photoreceptor 5 and charging roller 14. Assuming that the maximum and minimum values of the charging gap g in the change with a rotation of the image forming member to be Gmax and Gmin, respectively, at an arbitrary location in the axial direction of the image forming region on the photoreceptor 5, the charging gap g in the present invention is preferably formed to satisfy the relations, $$20\ \mu m \leqq g \leqq 80\ \mu m, \text{ and}$$

$$G\max - G\min \leqq 40\ \mu m,$$

at an arbitrary location in the axial direction of the photoreceptor 5.

Also, assuming that the maximum and minimum values of the charging gap g in the change with a rotation of the image forming member to be Gmax and Gmin, respectively, at an arbitrary location in the peripheral direction of the image forming region on the photoreceptor 5, the charging gap g is preferably formed to satisfy the relations, $$20\ \mu m \leqq g \leqq 80\ \mu m, \text{ and}$$

$$G\max - G\min \leqq 40\ \mu m,$$

at an arbitrary location on the periphery of the photoreceptor 5.

Figure 12:
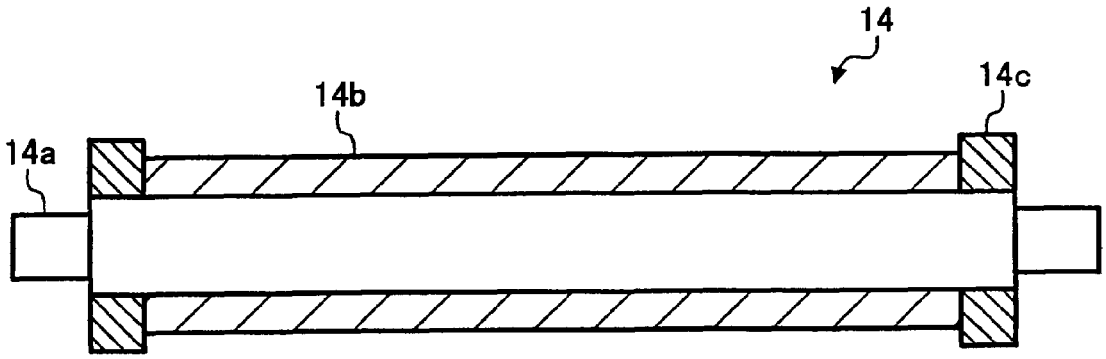
FIG. 12 is a cross sectional view illustrating a charging roller provided with gap holding members at respective ends thereof according to another embodiment disclosed herein.

FIG. 12 is a section view of the charging roller as the fourth embodiment thereof for use in the image forming apparatus.

Referring to FIG. 12, the charging roller 14 includes a rotating core shaft 14*a* of a metal bar as an electroconductive supporting member, a charging layer 14*b* consisting of electroconductive resin, and gap holding members 14*c*, 14*c* each formed of sheets on both ends of the charging roller 14.

The core shaft 14*a* is formed of metal such as stainless steel and other similar metals.

If the diameter of the core shaft 14*a* is too small, it may suffer from non-negligible bending during cutting works for forming the charging layer 14*b* or being pressed against the photoreceptor 5, whereby difficulty may result in attaining necessary gap accuracy. If the diameter is too large, in contrast, the size and weight of the charging roller 14 tend to be large. The diameter is therefore preferably in the range from 6 to 10 mm.

Examples of the materials for forming the charging layer 14*b* include the materials preferably having a volume resistance ranging from $10^4$ to $10^9$ Ωcm.

If the volume resistance is too small, the leakage of bias voltage may take place with more ease caused by minute defects such as pinholes. In case of too large volume resistance, by contrast, necessary discharge does not generate, whereby even charged potentials cannot be obtained.

The charging layer 14*b* may be formed having a suitable volume resistance by adding suitable electroconductive materials into the base resin. Examples of the materials for forming the base resin include polyethylene, polypropylene, polymethyl methacrylate, polystyrene, acrylonitrile-butadiene-styrene copolymer (ABS) and polycarbonate. These base resins can be fabricated with relative ease because of excellent moldability.

Examples of the electroconductive materials to be contained in the charging layer 14*b* include ion-conductive materials such as a quaternary ammonium salt containing polymer. Polyolefin which contains the quaternary ammonium salt is preferably used. Although the polyolefin is cited herein including the quaternary ammonium salt in the present embodiment, the polymers other than polyolefin may also be used including the quaternary ammonium salt.

The ion-conductive materials are compounded uniformly into the base resin by conventional methods using a kneader or biaxial mixer. The compounded material is subsequently injection or extrusion molded onto the core shaft 14*a* to thereby be shaped into a roller.

The amount of ion-conductive materials for the mixing is preferably in the range of 30 to 80 by weight per 100 by weight of base resin.

The thickness of the charging layer 14*b* preferably ranges from 0.5 to 3 mm. Too small the thickness of the charging layer 14*b* may cause difficulties in fabrication and inferior strength of the layer, while too large the thickness results in the decrease in charging efficiency caused by the resistance increase in addition to an undue increase in size of the charging roller 14.

After forming the charging layer 14*b*, gap holding members 14*c* which have been previously prepared, are affixed onto the respective ends of the core shaft 14*a* through at least one of fabrication methods such as press fitting and adhesive joining. The thus unified charging roller 14 and gap holding member 14*c* are subjected simultaneously to the steps of adjusting the diameter of charging roller 14 through cutting and polishing.

With the present construction of the charging roller 14, the core shaft 14*a* and gap holding members 14*c* can be brought to be in-phase in fluctuation during rotation and the variation in the charging gap g can be reduced.

The method adaptable to unifying the core shaft 14*a* with gap holding member 14*c* is not limited to the press fitting and adhesive joining. Other methods may also be applied such as, for example, two-toned molding which can mold two kinds of resins to thereby form both charging layer 14*b* and gap holding member 14*c* on the core shaft 14*a*.

Suitable materials for forming the gap holding member 14*c* include the resins similar to those for the base resins such as polyethylene, polypropylene, polymethyl methacrylates, polystyrene, acrylonitrile-butadiene-styrene copolymers, and polycarbonate.

Since the gap holding member 14*c* is brought into contact to the photosensitive layer 14*b*, the material for forming the gap holding member 14*c* preferably has hardness smaller than charging layer 107 to avoid possible damage to photosensitive layer 14*b*.

In addition, several materials may also be selected, for their excellent lubricating and less damaging properties, such resins as polyacetal, ethylene-ethylacrylate copolymers, polyvinylidene fluoride, tetrafluoroethylene-perfluoroalkyl vinylether copolymers, and tetrafluoroethylene-hexafluoropropylene copolymers.

Further, a surface layer may additionally be formed having a several-tens-micrometer thickness by conventional coating method with a composition to prevent undue toner adherence.

The charging roller 14 is provided with a gear mounted on respective end portions of the core shaft 14*a*, and the gear is engaged with a further gear mounted on a flange of the photoreceptor 5. The charging roller 14, therefore, rotates along the rotation of the photoreceptor 5 driven by a driving motor therefor with a linear velocity approximately equal to each other in an engaging direction.

Since the charging layer 14*b* of charging roller 14 is structured not in direct contact with the photoreceptor 5, the imaging portion of the photoreceptor 5 will not suffer from any damage such as surface scratch, for example, even in the case when a hard resin material is used for forming the charging layer 14*b* and an organic photoreceptor is used in the photoreceptor 5.

If the gap g becomes too large in width, an abnormal discharge may take place and uniform charging becomes difficult over the surface area of the photoreceptor 5. According to the results obtained from experiments by the inventor it has been found that the maximum gap width is preferably 80 μm or smaller.

Incidentally, the maximum gap width may be affected to a certain extent by the materials properties of the charging layer 14*b*. The fabrication with high accuracy is therefore requisite for both photoreceptor 5 and charging roller 14, and the rectilinearity of 20 μm or smaller is preferable for the structure.

In the structure previously known of the charging roller, in which the gap holding member is in contact to the support core of photoreceptor 5, the photosensitive layer has to be coated over the area outside the charging layer to prevent charging bias leak from the edge portion of the charging layer to the support core. This has resulted in undue increase in the support core length and concomitant increase in size of the printer apparatus as a whole.

According to the present invention, in contrast, it has become feasible to bring the gap holding member 14*c* into contact to the photosensitive layer by forming the gap holding member 14*c* using the material suitable for avoiding any damage to the photosensitive layer, and by disposing an additional protective layer on the surface of photosensitive layer sufficient to improve the mechanical strength and lubricating property thereof.

As a result, the charging layer 14*b* and gap holding member 14*c* can be disposed adjacent to each other as shown in FIG. 12. Therefore, the above noted difficulties can be alleviated such as undue increase in the support core length and concomitant increase in size of the printer apparatus as a whole.

Since the gap holding member 14*c* is in contact not to the support core but to the photosensitive layer of the photoreceptor, conductive materials may be used for forming the member 14*c*. However, it is preferable for the materials having high resistance to be used for that purpose in order to prevent unnecessary discharge and electrostatic adherence of toner and other particles onto the surface of the gap holding member 14*c*.

In the printer as an image forming apparatus disclosed herein, the charging gap g is further examined in the case where the gap holding member 14*c* and photoreceptor 5 are disposed being non-contact with each other.

At several points in the axial direction of the photoreceptor such as the point C corresponding to the middle, and E1 and E2 each corresponding to respective ends, of the image forming region 3, the values of the charging gap g are obtained.

And, several assumptions are made such as (i) Gmax (C), Gmax (E1) and Gmax (E2) as the maxima of the gap between gap holding member 14*c* and photoreceptor 5 at the middle, and E1 and E2 at respective ends, of the image forming region 3, respectively;

(ii) Gmin (C), Gmin (E1) and Gmin (E2) as the minima of the gap at the middle, and E1 and E2 at respective ends, respectively;

(iii) Gmax as the maximum among Gmax (C), Gmax (E1) and Gmax (E2); and (iv) Gmin as the minimum among Gmin (C), Gmin (E1) and Gmin (E2).

Under the above notations, the charging gap in the present invention is preferably formed to satisfy the relations, $$20\ \mu m \leqq Gmin\ (C, E1, E2),$$

$$Gmax\ (C, E1, E2) \leqq 80\ \mu m, \text{ and}$$

$$Gmax - Gmin \leqq 40\ \mu m.$$

Figure 13:
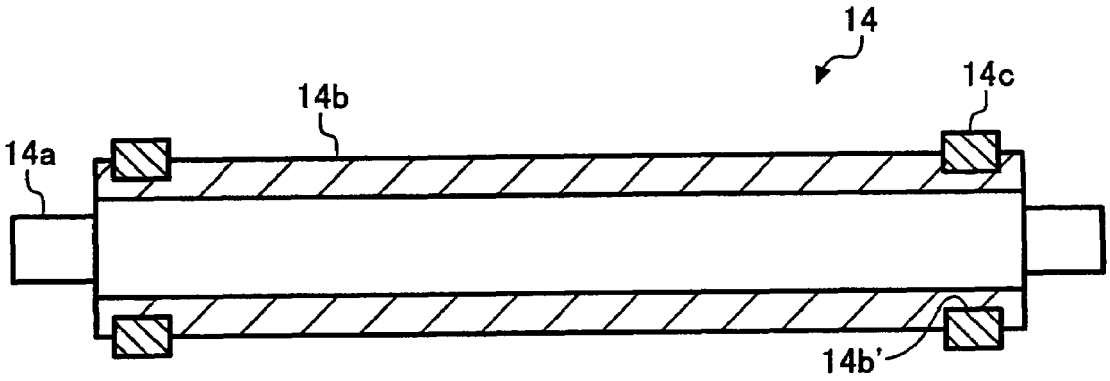
FIG. 13 is a cross sectional view illustrating a charging roller provided with holding members each fitted to step portions at respective ends of the charging roller according to another embodiment disclosed herein.

FIG. 13 is a section view of the charging roller as the fifth embodiment thereof for use in the image forming apparatus.

Referring to FIG. 13, in a similar manner to the fourth embodiment, the charging roller 14 includes a rotating core shaft 14*a* formed of a metal bar as an electroconductive supporting member, a charging layer 14*b* consisting of electroconductive resin, and gap holding members 14*c*, 14*c* each formed of sheets on both ends of the charging roller 14. In addition, a step portion 14*b*' is further provided in the present embodiment.

The step portions 14*b*' each provided with circular grooves at the both ends of the charging roller 14 in the course of shaping the outer face of the charging layer 14*b*, which is carried out by shaving steps (including cutting and grinding). The step portions 14*b*' are each formed as circular grooves, and serve to fix the gap holding member 14*c* with precision at respective ends of charging layer 14*b* by fitted later with gap holding members 14*c*.

The gap holding members 14*c* are each made of tubes of heat shrinking resin consisting fluorocarbon resins such as PFA (tetrafluoroethylene-perfluoroalkyl vinylether copolymers) and FEP (tetrafluoroethylene-hexafluoropropylene copolymers), to be brought in tightfitting into the step portions 14*b*' by applying heat.

These materials are known to have excellent releasing properties and effective for preventing the adherence of the toner. By using further fluorine resins for the materials, the discharge at the gap holding members 14*c* can be prevented as well as the adherence of the toner.

Since the gap holding members 14*c* are formed by fitting into the circular groove formed in the step portion 14*b*', as mentioned above, respective edges of the groove operate as a latch for the gap holding members 14*c*. As a result, slipping out of the step portion can be prevented for the gap holding members 14*c* without using any adhesive agent.

The depth d of the step portions 14*b*' may appropriately be determined after considering the thickness t of the heat contracting tube as the gap holding member and the charging gap g as the present target.

Also in the present embodiment, respective gears of the charging roller 14 are engaged with the gears disposed at the ends of the photoreceptor 5. The charging roller 14 then rotates in synchronous with the rotation of the photoreceptor 5 with an approximately constant velocity.

Since the charging layer 14*b* of charging roller 14 is structured not in direct contact with the photoreceptor 5, the imaging portion of the photoreceptor 5 will not suffer from any damage such as surface scratch, for example, even in the case when a hard resin material is used for forming the charging layer 14*b* and an organic photoreceptor is used in the photoreceptor 5.

In addition, since the charging gap is determined by charging roller 14 and photoreceptor 5, and the burden of the charging roller rotation is centered primarily at the gap holding member 14*c*, sufficient durability is essential for the heat shrinking tube.

It should be noted in this context, the gap holding member in previously known charging rollers has often been formed by affixing ones in the shape of tape as thin as approximately 10 μm on the surface of the charging layer. In this method, however, sufficient durability has not been achieved due to tape wear particularly in the case using resins for forming the gap holding member.

In the present embodiment in contrast, sufficient durability can be achieved by providing the step portions 14*b* and disposing the heat shrinking tube of a thickness ranging 150 to 300 μm by fitting into the step portion.

It should be also added that heat shrinking tubes generally have a deviation in thickness of about 10%, and too large thickness for the tube, therefore, isn't preferable due to concomitant increase in deviation of the charging gap.

As described earlier, the charging gap g always fluctuates within a certain range with the rotation of the photoreceptor 5 and charging roller 14.

In order for the photoreceptor 5 to be charged in uniform, it is effective to have a charging bias applied to the charging roller 14 to be a properly determined DC bias superposed by an AC bias having a peak-to-peak voltage of at least twice the discharge starting voltage between photoreceptor 5 and charging roller 14.

In addition, since uneven charging in stripe shape is appreciable for low frequency of the applied AC bias, the frequency of the AC bias is preferably set equal to, or larger than the frequency f (Hz) corresponding to seven times linear velocity V (mm/s) of the photoreceptor.

Furthermore, since abnormal discharge takes place for too high frequencies of the applied AC bias, which tends to cause the increase in abrasion rate of the photoreceptor 5 and the generation of filming of toner and external additives, it is preferred for the frequency of the AC bias be adjusted equal to, or smaller than the frequency f (Hz) corresponding to twelve times linear velocity V (mm/s) of the photoreceptor. That is, the relation to preferably be satisfied in the present embodiment is $7 \times V < f < 12 \times V$.

When the DC bias is superposed by the AC bias, the influence on the roller resistance from environment can be reduced by adopting the constant current control.

It should be noted in this case, however, when the photoreceptor 5 and charging roller 14 are placed in a non-contact arrangement, the charging gap g fluctuates with the rotation of the photoreceptor 5 and charging roller 14. In the constant current control mode, the fluctuation may result several undue effects such as the failure in voltage follow-up by high voltage source and concomitant emergence of abnormal images. This difficulty can be obviated by adopting the constant voltage mode for the AC bias.

It is also noted that the necessary AC bias voltage is different depending on the change in roller resistance due to environmental conditions and the magnitude of the charging gap, in which necessary AC bias voltage becomes higher with increasing charging gap. This AC voltage can properly be set by providing suitable means capable of detecting AC current, monitoring and then readjusting the AC current in the off-period during image forming cycles.

The photoreceptor suitably used in the present embodiment is one similar in structure and function to those used in the first embodiment, in which a layered structure formed on an electroconductive substrate includes a charge generation layer 203, a charge transport layer 204, and a protective layer 205.

The details on the constituent layers are therefore abbreviated herein except protective layer 205. As briefly mentioned earlier, the protective layer 205 is utilized in the present embodiment to improve the mechanical strength and lubricating property of the photosensitive layer, which is particularly useful for bringing the gap holding member 14*c* into contact to the photosensitive layer without damage, and for disposing the charging layer 14*b* and gap holding member 14*c* adjacent to each other. Therefore, one of previous difficulties can be obviated such as undue increase in the support core length and concomitant increase in size of the printer apparatus as a whole.

This protective layer 205 may be formed as an uppermost layer on the photoreceptor 5, including at least resinous materials and further containing metal oxide particles.

Examples of the resinous materials include polybutylene terephthalate resins, polycarbonate resins, polyethersulfone resins, polyethylene resins, polyethylene terephthalate resins, polyimide resins, acrylic resins, polymethylpentene resins, polypropylene resins, polyphenyleneoxide resins, polysulfone resins, polyurethane resins, polyvinyl chloride resins, polyvinylidene chloride resins, epoxy resins and other similar resins.

Examples of the suitable solvent include tetrahydrofuran, toluene and dichloroethane.

In order to improve the abrasion resistance, as indicated earlier, metal oxide particles can be included in the resin of protective layer 205 such as alumina, silica, titanium oxide, tin oxide, zirconium oxide and indium oxide.

The amount of the oxide particles included in the resin is generally in the range from 5 to 40% by weight and preferably from 10 to 30%.

The amount of 5% or less results a relatively large abrasion with inferior resistance, while the amount of the metal oxide particles exceeding 40% causes another adverse effect of a considerable increase in the potential in bright portions during exposure to such an extent that the decrease in sensitivity cannot be neglected.

The diameter of the metal oxide particles added to the protective layer 205 is preferably in the range from 0.1 to 0.8 μm. If the diameter is too large, the surface ruggedness of protective layer 205 increases and cleaning properties decreases. As a result, light beams for the image exposure are scattered with more ease and image resolution decreases. In case of too small the diameter, by contrast, anti-abrasion capability of the photoreceptor decreases.

As the method for forming the protective layer 205, a coating method such as spray coating can be utilized.

The thickness of protective layer 205 is generally in the range from 1 to 10 μm and preferably from 3 to 8 μm. Too small a thickness of the protective layer 205 results inferior resistance, while too large a thickness causes not only a decrease in productivity of the photoreceptor during manufacturing but also an increase in residual potential after prolonged usage.

In addition, lubricant particles of fluorocarbon resin, for example, can be dispersed in the protective layer 205 to improve the lubricating properties of the surface of photoreceptor 5.

The amount of the resin lubricant particles included in the surface layer is preferably in the range from 40 to 75% by weight of the solid additives in the layer. The amount of less than 40% by weight is unsatisfactory for slight effects of lubrication improvement, while the amount of larger than 75% by weight is also unsatisfactory because of the decrease in the mechanical strength of the layer.

Examples of the fluorocarbon resin include polytetrafluoroethylene, polyhexafluoroethylene, polytrifluoroethylene, polyvinylidene fluoride and polyvinyl fluoride.

The diameter of the fluorocarbon lubricant particles dispersed in the protective layer 205 is preferably in the range from 0.1 to 5 μm.

The lubricant particles can be dispersed in a manner similar to the metal oxide particles using similar binders and resins utilizing the spray coating method, for example. The thickness of the surface layer 205 is preferably in the range from 3 to 8 μm.

In addition, the metal oxide and lubricant particles can be dispersed into protective layer 205 individually or in combination. Further, a dispersing agent may additionally be included in the protective layer 205 to improve dispersibility of the particles of metal oxide and fluorocarbon resins. Examples of the dispersing agent suitably include those used with conventional coating compositions such as paint.

Still further, some of the aforementioned charge transport materials may effectively included and antioxidants may also be included in the protective layer 205, where relevant.

As the eighth embodiment according to the present invention, a further charging roller 14 was formed as follows.

Over the surface area of a stainless steel core shaft 14*a* having an 8-mm-diameter, a charging member 14*b* is formed by injection molding a resin composition, which contains 60 parts by weight of ion-conductive agent consisting of polyolefin polymer with quaternary ammonium salt in 100 parts by weight of ABS resin (volume resistance of $10^6$ Ωcm for the resultant charging layer).

Thereafter, gap holding members 14*c* formed of polyethylene were fixed to both ends of the charging member 14*b*, then ground such that the difference in the outer diameter was obtained as 50 μm between the charging member 14*b* and gap holding member 14*c*, whereby the charging roller was formed having a 12-mm-diameter (having the structure of FIG. 12).

A still further charging roller 14 is formed as the ninth embodiment by repeating similar steps to those for forming the charging roller according to the fourth embodiment described above with the exception that the conditions during grinding were set to result in a larger roller fluctuation.

As the tenth embodiment, another charging roller 14 was formed by utilizing similar core shaft 14*a* and conductive resin to those of the fourth embodiment, also by injection molding.

In the course of shaping the outer face of the roller structure by cutting and grinding, step portions were formed having the shape of grove at the both ends of the structure. Heat shrinking PFA tubes were then fixed to respective ends by heating at 120° C. for 20 minutes so as to result in a 150-μm-thick tube after shrinking, whereby gap holding members 14*c* were formed.

Thereafter, the step portions were formed to obtain the difference in the outer diameter as 50 μm between the charging member 14*b* and gap holding member 14*c*, whereby the charging roller was formed having a 12-mm-diameter (having the structure of FIG. 13).

As the eleventh embodiment, another charging roller 14 was formed by using similar materials to those of the above noted tenth embodiment, with the exception that the conditions were intentionally set to vary the depth of the grove during the groove formation at respective ends of the charging roller such that a deviation in charging gap was obtained.

Still another charging roller 14 was formed as the twelfth embodiment by using similar materials to those of the tenth embodiment, with the exception that the conditions were set to change the depth of the grove during the groove formation at respective ends of the charging roller such that a deviation in charging gap was obtained larger than that of the charging roller 14.

Evaluation process steps were then carried out on the thus formed charging rollers 14 using the image forming system IPSiO Color 8110.

The photoreceptor for use in the evaluation was prepared as a multilayered structure formed on an aluminum base having a 30-mm-diameter, with several layers formed successively on the substrate such as an undercoat layer having a 3.5-μm-thickness, a charge generation layer having a 0.15-μm-thickness, a charge transport layer having a 22-μm-thickness, and a protective layer having a 5-μm-thickness, in that order.

The protective layer was formed by spray coating. The layers other than the protective layer were formed by dip coating. As the binder resin for use in both the charge transport and surface layers, polycarbonate was used, and alumina particles having a 0.3-μm-average diameter were included in the surface layer in an amount of 25% by weight per all solid contents in the layer.

The fluctuation of accuracy in the outer diameter and rectilinearity of the present photoreceptor was confirmed to be sufficiently smaller compared with that of several charging rollers used during the measurements.

The photoreceptor 5 and charging roller 14 were properly set in a photoreceptor unit 2A. The photoreceptor unit was, in turn, placed in the aforementioned charging gap measuring unit 60 (FIG. 11). With such an arrangement, the charging gap was measured under actual working conditions with high accuracy.

Charging gap measurements were carried out at three locations such as at the frontal side E1, center C, and rear side E2, on the image forming region in the longitudinal direction of image bearing member. In addition, the numbers of gear tooth were selected to be Nc=13 and Np=35 for the charging roller and the photoreceptor, respectively.

The results obtained from the measurements are summarized in Table 4 on the margin of the charging gap fluctuation. The relation between the examples and the embodiments of charging rollers will be described shortly.

TABLE 4

Results of charging gap measurements

| Charging roller | Charging gap (μm) E1 | C | E2 |
|---|---|---|---|
| Example 2 | 40~55 | 25~45 | 45~55 |
| Comparative ex. 1 | 35~60 | 15~40 | 40~65 |
| Example 3 | 40~65 | 25~55 | 45~65 |
| Comparative ex. 2 | 25~50 | 35~65 | 55~75 |
| Comparative ex. 3 | 10~35 | 25~60 | 70~90 |

Each of the thus prepared charging rollers was then mounted in the image forming apparatus to be subjected several tests.

With respect to images formed in especially half-tone images, an abnormal feature emerges under insufficient AC charging bias conditions such as light or dark spots in the images. Therefore, Vp−p for the AC bias was gradually increased to find a sufficient Vp−p value at which no abnormal features were observed.

Thereafter, several running tests were carried out under the sufficient Vp−p value by continuously producing 20,000 copies, to subsequently examine output images and the outward appearance of both photoreceptor 5 and charging rollers 14. Additional experimental conditions were a processing speed of 125 mm/s, and an applied charging voltage, AC (f=900 Hz)+DC (−700 V).

EXAMPLE 2

A running test was carried out for the combination of the photoreceptor 5 and the charging roller 14 formed as abovementioned eighth embodiment, which was provided with gap holding members 14*c* formed of polyethylene fixed to both ends of the charging member 14*b*.

Although abnormal images having light or dark spots were found under insufficient AC charging bias conditions, this difficulty was obviated by setting the AC charging bias Vp−p as 2.1 kV to result in images of uniform density. Therefore, the running test was performed at the 2.1 kV bias.

After outputting 20,000 copies, no abnormality was recognized on the output images and outward appearance of photoreceptor. In addition, the charging roller 14 by itself had no appreciable contamination even though few toner particles were found on the cleaning brush.

EXAMPLE 3

Another running test was carried out for the combination of the photoreceptor 5 and the charging roller 14 formed as abovementioned tenth embodiment, which was provided with the step portions each groove-shaped at the both ends of the structure fit by heat shrinking PFA tube.

Although abnormal images having light or dark spots were found under insufficient AC charging bias conditions, this difficulty was obviated by setting the AC charging bias Vp−p as 2.2 kV to result in images of uniform density. The running test was therefore performed at the 2.2 kV bias.

After outputting 20,000 copies, no abnormality was recognized on the output images and outward appearance of photoreceptor. In addition, the charging roller 14 had no appreciable contamination even though few toner particles were found on the cleaning brush.

COMPARATIVE EXAMPLE 1

Still another running test was carried out for the combination of the photoreceptor 5 and the charging roller 14 formed as abovementioned ninth embodiment, which was intentionally provided with the larger roller fluctuation.

Although abnormal images having light or dark spots were found under insufficient AC charging bias conditions, this difficulty was obviated by setting the AC charging bias Vp−p as 2.2 kV to result in images of uniform density. The running test was therefore performed at the 2.2 kV bias.

After outputting 20,000 copies, uneven image density of stripe-shaped along the vertical scanning direction emerged at the center portions of half-tone images. In addition, although no abnormality was recognized on the appearance of photoreceptor 5, it was found the center portion of charging roller 14 had toner contamination.

After several attempts to remove this toner contamination, the removal was found feasible not by dry-wiping with waste cloth but with ethanol. And, no abnormal images were formed after wiping the charging roller 14 with ethanol. It is therefore considered the stripe-shaped abnormal images were caused by toner particles adhered to the charging roller 14.

COMPARATIVE EXAMPLE 2

Another running test was carried out for the combination of the photoreceptor 5 and the charging roller 14 formed as abovementioned eleventh embodiment, which was intentionally provided with deviation in the charging gap.

Although abnormal images having light or dark spots were found under insufficient AC charging bias conditions, this difficulty was obviated by setting the AC charging bias Vp−p as 2.4 kV to result in images of uniform density. The running test was then performed at the 2.2 kV bias.

After outputting 20,000 copies, uneven image density of stripe-shaped along the vertical scanning direction distinctly emerged at the frontal portions of half-tone images. In addition, there observed were toner filming at frontal portions of the photoreceptor 5 and toner contamination also at the frontal portions of the charging roller 14.

COMPARATIVE EXAMPLE 3

Another running test was carried out for the combination of the photoreceptor 5 and the charging roller 14 formed as abovementioned twelfth embodiment, which was intentionally provided with larger deviation in the charging gap.

Abnormal images of a scary pattern emerged at the rear side of the images only after forming 14 copies, and uniform charging could not achieved even after increasing the bias Vp−p to 2.7 kV. Even though no uniform-density images could be formed at the 2.7 kV bias, the running test was attempted at this bias Vp−p bias.

After outputting 20,000 copies, uneven image density of stripe-shaped along the vertical scanning direction distinctly emerged at the frontal portions of half-tone images, and the scary pattern similar to that during initial periods as abovementioned was found at the rear side of the images. At the same time, there observed were toner filming at frontal portions of the photoreceptor 5 and toner contamination also at the frontal portions of the charging roller 14 with an increasing degree in approaching the frontal edge portion.

From the results of the running tests taken with the previous results on the charging gap measurements summarized in Table 4, it is clearly shown that an upper limit exists for the charging gap not to generate abnormal images in an image forming apparatus provided with the photoreceptor 5 and the charging roller 14 in the non-contact arrangement and that it is unfeasible to achieve uniform charging of the photoreceptor 5 with the charging gap beyond this limit even after applying increased AC charging bias voltages.

In addition, even for the charging gap smaller than the upper limit, necessary AC charging bias voltages Vp−p to be applied become higher with the increase in charging gap. Therefore, AC charging bias voltages Vp−p has to be set high enough to achieve uniform charging even for the largest gap portion in the present configuration of the photoreceptor 5 and the charging roller 14.

If the deviation of charging gap is relatively large in the above configuration, the aforementioned charging energy becomes excessive in the portions having smaller charging gaps. As a result, it is considered the toner filming is caused with more ease on the photoreceptor.

Furthermore, it is also shown from the results that the contamination on the charging roller 14 is caused more often with decreasing the charging gap and increasing AC charging bias voltages Vp−p.

Therefore, in order to output stable images over a long period of time by means of the image forming apparatus provided with the charging roller in the non-contact arrangement, it is essential not only to control the charging gap below the noted upper limit as to sufficiently achieve uniform charging but also to reduce as much as possible the fluctuation margin and deviation of the charging gap.

It is apparent that there has been provided in accordance with the present invention, charging units and image forming apparatuses having advantages over those previously known.

For example, the undue variation and fluctuation margin of charging gap are reduced and proper charging gaps can be controlled with high accuracy durably over the change of environmental conditions. This becomes feasible by the structure of the charging unit according to the present invention, in which the charging gap is formed by providing an image bearing member having a shape of roller formed of resin, and then gap holding members formed of insulating resin to be brought into contact to the outside region on the image bearing member.

In addition, accurate charging gap control becomes feasible by the means provided in the invention for controlling the fluctuation margin of the charging gap, caused by the change of environmental conditions, in terms of fluctuation characteristics of the charging member by setting a materials condition of the charging member beforehand within a predetermined range, as detailed earlier.

As a result, both the contamination from toner adhesion on the surface of charging roller and the abrasion of the surface of photoreceptor can be reduced, and uneven image density caused by abnormal discharge can be obviated. Therefore, excellent qualities can be achieved in image duplication.

The abrasion of the photoreceptor is also suppressed by another means of the present invention, which is related to the bias application. The charging bias cannot be large enough to retain a suitable charging voltage where the charging gap is large, while discharge energy may be too large at the location where the charging gap is small in the case where a large deviation exits in the charging gap, As a result, the increase in photoreceptor abrasion takes place by the excessive discharge energy generated in the smaller gap portions. Although the DC bias superposed by the AC bias can be reduced by adopting the constant current control, this is further enhanced by adopting the constant voltage mode for the AC bias as performed in the present invention to appropriately overcome the failure in voltage follow-up by high voltage source in the constant current control.

This also contributes uniform charging over the image forming area on the photoreceptor, which yields, in turn, excellent qualities in image duplication.

In addition, the durability of the photoreceptor increases further by including metal oxide particulates in the protective layer as an uppermost layer overlying the photosensitive layer of organic photoconductor. Also, lubricant particles of fluorocarbon resin, for example, can be dispersed in the protective layer to improve the lubricating properties of the surface of image bearing member. Therefore, abrasion resistance and mechanical strength of an organic photoconductor is improved for the organic photoconductor.

Also in this case, the gap forming members each formed to be in contact with the surface of the photosensitive layer outside of image forming region of the photoreceptor, and degradation of the photoreceptor can be alleviated. In addition, with the present structure providing circular groove formed in the step portion to be fit with a gap forming member, slipping out of the gap forming member from the step portion can be prevented without using any adhesive agent.

Still in addition, the means for performing measurements of charging gaps is provided in the range of several tens of microns under actual operating conditions without complex and costly mechanisms. Utilizing a light emitting device and light receptor constructed integrally in the measuring unit such that the unit as a whole can travel in the longitudinal direction of the photoreceptor, the measurement of the charging gap can be performed at an arbitrary position along the longitudinal direction of the photoreceptor. With such an arrangement, it becomes feasible to measure the charging gap under working conditions with high degree of accuracy. This is quite useful for the measurements and adjustment of the charging gaps over period of time even through the operation period.

Furthermore, the photoreceptor in the invention is uniformly charged by applying a properly determined DC bias superposed by an AC bias having a peak-to-peak voltage of at least twice the discharge starting voltage between photoreceptor and charging roller. In addition, since uneven charging in stripe shape is appreciable for low frequency of the applied AC bias, the frequency of the AC bias is preferably set equal to, or larger than the frequency f (Hz) corresponding to seven times linear velocity V (mm/s) of the photoreceptor.

And, since abnormal discharge takes place for too high frequencies of the applied AC bias, which tends to cause the increase in abrasion rate of the photoreceptor and the generation of filming of toner and external additives, it is preferred for the frequency of the AC bias be adjusted equal to, or smaller than the frequency f (Hz) corresponding to twelve times linear velocity V (mm/s) of the photoreceptor.

The charging unit may suitably be included in an integral structure, a process cartridge, with an image bearing member and other devices, where relevant, to subsequently be incorporated into the printer. This process cartridge can be handled conveniently as a single unit detachably with respect to the casing main body of the full-color printer.

By arranging the photoreceptor and charging unit in such a structure as mentioned just above, the arrangement thereof can be definitely fixed, the exchange of parts or units in the apparatus can be performed even by a customer with relative ease with precision. This is illustrated by the process of charging gap adjustment in the present invention; even when a minute adjustment is required such as the charging gap adjustment between the photoreceptor and charging roller, no inordinate step of gap adjustment is required since both the charging roller and the photoreceptor can be replaced simultaneously as a single structure, the process cartridge.

The thus formed charging unit is suitably incorporated into the full-color printer, as an image forming apparatus, in the invention, individually or in combination as the process cartridge, whereby excellent and durable image qualities are attained in electrophotographic imaging.

The process steps set forth in the present description on the charging unit and image forming apparatus may be implemented using conventional general purpose microprocessors, programmed according to the teachings in the present specification, as will be appreciated to those skilled in the relevant arts. Appropriate software coding can readily be prepared by skilled programmers based on the teachings of the present disclosure, as will also be apparent to those skilled in the relevant arts.

The present specification thus include also a computer-based product which may be hosted on a storage medium, and include instructions which can be used to program a microprocessor to perform a process in accordance with the present disclosure. This storage medium can include, but not limited to, any type of disc including floppy discs, optical discs, CD-ROMs, magneto-optical discs, ROMs, RAMs, EPROMs, EEPROMs, flash memory, magnetic or optical cards, or any type of media suitable for storing electronic instructions.

Obviously, additional modifications and variations of the present invention are possible in light of the above teachings. It is therefore to be understood that within the scope of the appended claims, the invention may be practiced otherwise than as specifically described herein.

What is claimed is:

1. An image forming apparatus, comprising:

an image bearing member; and a charging unit configured to charge said image bearing member in a non-contact arrangement, said charging unit comprising a charging roller; wherein said charging roller and said image bearing member are provided so as to satisfy relations, $$20\ \mu m \leqq Gmin\ (C, E1, E2),$$

$$Gmax\ (C, E1, E2) \leqq 80\ \mu m, \text{ and}$$

$$Gmax - Gmin \leqq 40\ \mu m,$$

where, representing by C, E1 and E2 several locations on an image forming region of said image bearing member such as a middle and respective ends, respectively, (i) Gmax (C), Gmax (E1) and Gmax (E2) are maxima of the charging gap at the respective locations in a change with a rotation of said image bearing member; (ii) Gmin (C), Gmin (E1) and Gmin (E2) are minima of the charging gap similarly at the respective locations; (iii) Gmax is a maximum among Gmax (C), Gmax (E1) and Gmax (E2); and (iv) Gmin is a minimum among Gmin (C), Gmin (E1) and Gmin (E2).

2. The image forming apparatus according to claim 1, wherein said charging roller is applied by a DC bias superposed with an AC bias, and wherein the AC bias is subjected to a constant voltage control at least during image forming operation.

3. The image forming apparatus according to claim 2, wherein the DC bias is superposed with the AC bias so as to satisfy a relation, $$7 \times V < f < 12 \times V,$$

where f is a frequency (Hz) of the AC bias and v is a linear velocity (mm/s) of said image bearing member.

4. A charging unit, said charging unit being incorporated into an image forming apparatus, said image forming apparatus comprising:

an image bearing member; and a charging unit configured to charge said image bearing member in a non-contact arrangement, said charging unit comprising a charging roller; wherein said charging roller and said image bearing member are provided so as to satisfy relations, $$20\ \mu m \leqq Gmin\ (C, E1, E2),$$

$$Gmax\ (C, E1, E2) \leqq 80\ \mu m, \text{ and}$$

$$Gmax - Gmin \leqq 40\ \mu m,$$

where, representing by C, E1 and E2 several locations on an image forming region of said image bearing member such as a middle and respective ends, respectively, (i) Gmax (C), Gmax (E1) and Gmax (E2) are maxima of the charging gap at the respective locations in a change with a rotation of said image bearing member; (ii) Gmin (C), Gmin (E1) and Gmin (E2) are minima of the charging gap similarly at the respective locations; (iii) Gmax is a maximum among Gmax (C), Gmax (E1) and Gmax (E2); and (iv) Gmin is a minimum among Gmin (C), Gmin (E1) and Gmin (E2); and wherein further the charging gap between said image bearing member and said charging roller is formed by providing two gap holding members formed of insulating resin each disposed at respective ends of said charging roller, and bringing said two gap holding members into contact to a region outside an image forming region of said image bearing member.

5. The charging unit according to claim 4, wherein the charging gap between said image bearing member and said charging roller is formed by forming two step portions each disposed at respective ends of said charging roller, providing two gap holding members formed of heat-shrinking insulating resin each to be fit respective said two step portions, and bringing said two gap holding members in contact to the region outside the image forming region of said image bearing member.

6. A charging unit, said charging unit being incorporated into an image forming apparatus, said image forming apparatus comprising:

an image bearing member; and a charging unit configured to charge said image bearing member in a non-contact arrangement, said charging unit comprising a charging roller; wherein said charging roller and said image bearing member are provided so as to satisfy relations, $$20\ \mu m \leqq Gmin\ (C, E1, E2),$$

$$Gmax\ (C, E1, E2) \leqq 80\ \mu m, \text{ and}$$

$$Gmax - Gmin \leqq 40\ \mu m,$$

where, representing by C, E1 and E2 several locations on an image forming region of said image bearing member such as a middle and respective ends, respectively, (i) Gmax (C), Gmax (E1) and Gmax (E2) are maxima of the charging gap at the respective locations in a change with a rotation of said image bearing member; (ii) Gmin (C), Gmin (E1) and Gmin (E2) are minima of the charging gap similarly at the respective locations; (iii) Gmax is a maximum among Gmax (C), Gmax (E1) and Gmax (E2); and (iv) Gmin is a minimum among Gmin (C), Gmin (E1) and Gmin (E2); and wherein further the charging gap between said image bearing member and said charging roller is formed by providing two gap holding members formed of insulating resin each having an outer diameter slightly larger by a predetermined length than said charging roller, each being disposed at respective ends of said charging roller, and bringing said two gap holding members into contact to a region outside an image forming region of said image bearing member.

7. An image forming apparatus, comprising:

image bearing means; and charging means configured to charge said image bearing means in a non-contact arrangement, said charging means comprising charging roller means; wherein said charging roller means and said image bearing means are provided so as to satisfy relations, $$20\ \mu m \leqq Gmin\ (C, E1, E2),$$

$$Gmax\ (C, E1, E2) \leqq 80\ \mu m, \text{ and}$$

$$Gmax - Gmin \leqq 40\ \mu m,$$

where, representing by C, E1 and E2 several locations on an image forming region of said image bearing means such as a middle and respective ends, respectively, (i) Gmax (C), Gmax (E1) and Gmax (E2) are maxima of the charging gap at the respective locations in a change with a rotation of said image bearing means; (ii) Gmin (C), Gmin (E1) and Gmin (E2) are minima of the charging gap similarly at the respective locations; (iii) Gmax is a maximum among Gmax (C), Gmax (E1) and Gmax (E2); and (iv) Gmin is a minimum among Gmin (C), Gmin (E1) and Gmin (E2).

* * * * *